United States Patent [19]

Coski

[11] 4,332,420

[45] Jun. 1, 1982

[54] RECIPROCABLY SUPPORTED DUAL DRIVE MEMBER AND FEATURES THEREOF

[76] Inventor: William D. Coski, 3061-69th SE., Mercer Island, Wash. 98040

[21] Appl. No.: 111,322

[22] Filed: Jan. 11, 1980

[51] Int. Cl.[3] ..... E21D 9/10; E21D 9/12

[52] U.S. Cl. ..... 299/31; 173/142; 175/94; 299/81; 299/90; 299/56

[58] Field of Search ..... 299/31, 18; 175/94, 175/93; 405/138, 141, 143; 173/142-144, 53, 113, 71

[56] References Cited

U.S. PATENT DOCUMENTS

| | | | |
|---|---|---|---|
| Re. 28,449 | 6/1975 | Edmond | 175/94 |
| 1,001,903 | 8/1911 | Temple | 299/31 |
| 1,844,874 | 2/1932 | Smith et al. | 173/142 |
| 2,684,055 | 7/1954 | Bergman | 173/71 X |

*Primary Examiner*—Ernest R. Purser
*Attorney, Agent, or Firm*—Seed, Berry, Vernon & Baynham

[57] ABSTRACT

The reciprocably supported member is accompanied by means whereby its stroke can be relocated so that it can be used to drive its support if desired, even while it is simultaneously driving a tool or the like connected therewith. Also, the member may have its own onboard drive means; as well as onboard means for removing any debris that the tool generates. The drive means may comprise a combustion engine and the debris removal means may use the combustion gases of the engine as a flush medium for the same. Ordinarily, the flush medium is discharged adjacent the outer periphery of the working face of the tool and removes the debris through apertures adjacent the outer peripheral edge of the same. Other features are also described.

98 Claims, 9 Drawing Figures

RECIPROCABLY SUPPORTED DUAL DRIVE MEMBER AND FEATURES THEREOF

THE INVENTION IN GENERAL

This invention relates to a moveably supported member which is reciprocable in relation to its support. According to the invention, there are means combined with the member which are operable to determine the length and location of its stroke along the axis of reciprocation thereof, so that points on the member and the support are spaced apart from one another when the member is at the limit of its stroke in one direction of reciprocation thereof. There are also means whereby the location of the stroke can be shifted along the axis without substantially changing the length of the stroke, to relocate the points in closer proximity to one another when the member is at the limit of its stroke in the one direction of reciprocation thereof.

There are various utilities for this combination. For example, in the presently preferred embodiments of the invention, the points are operatively engagable with one another, and the stroke shifting means are operable to engage the points for various purposes when the member is at the limit of its stroke in the aforesaid one direction of reciprocation thereof. In some embodiments, for example, the support is moveably connected with the ground and the stroke shifting means are operable to enable the member to move the support in relation to the ground when the points are so engaged with one another.

To illustrate, in certain embodiments of the invention, a tool is connected with the member and the member is operable to drive the tool in relation to a work object at a work station. Meanwhile, the stroke shifting means are operable to enable the member to move the support thereof relative to the object and/or the station. In some embodiments, the tool is carried on the member and conjointly reciprocable therewith. Also, in certain instances, the tool is rotatably carried on the member, and there are means on the member whereby the tool can be rotated about the axis of reciprocation thereof while the member is reciprocating along the same. There are also means for compensating for momentum lost by the member when the points are engaged with one another to move the support in relation to the object and/or the station, and/or the tool is engaged with the work object.

Preferably, the stroke shifting means are also operable to relocate the points at greater distances from one another when the member is at the aforesaid limit of its stroke in the one direction of reciprocation thereof. In this way, they are also operable to disengage the points from one another, for example, when it is desired to reciprocate the member in relation to its support without moving the support in relation to the ground, in those instances where the support is moveably connected with the ground.

Furthermore, there are preferably pairs of points on the member and the support which are operatively engagable with one another in the opposing directions of reciprocation of the member, and the stroke shifting means are operable to engage alternate pairs of points with one another, for example, when it is desired to move the support in opposing directions, in those instances where the support is moveably connected with the ground. This makes it possible, for example, to advance the support relatively toward a work object, and then to retract the support relatively away from the object. Meanwhile, the tool can be driven in relation to the object, if desired.

In many of the presently preferred embodiments of the invention, the stroke determining means include means which are responsive to reciprocation of the member to yieldably bias the points into the disengaged condition thereof, and the stroke shifting means are operable to vary the bias on the points so that they can engage one another when the member is reciprocated in the one direction thereof. In certain embodiments, the yieldable biasing means include a yieldable biasing element which is interconnected between the member and its support to tend to cause the points to disengage from one another. The stroke shifting means include a yieldably biased control element which is interconnected between the member and the support to delimit the extent by which the points disengage from one another under the bias of the yieldable biasing element, and means for varying the bias on the control element to engage the points against the bias of the yieldable biasing element when the member is reciprocated in the one direction thereof. In some embodiments, the control element is double-ended and relatively reciprocably interconnected with the member and the support so that the respective end portions thereof are disposed on opposite sides of the same from the yieldable biasing element. One of the end portions is yieldably biased in one direction of reciprocation of the control element, and the other is reciprocably engaged in a servomotor which is fluid operated to reciprocate the control element in the other direction of reciprocation thereof against the bias on the one end portion, to engage the points, or alternatively, permit the control element to reciprocate in the one direction thereof under the bias on the one end portion, to disengage the points.

The invention also relates to a moveably supported member which is reciprocable in relation to its support and has conjointly reciprocable drive means thereon for reciprocating the same. According to the invention, the drive means comprise a reciprocably engaged piston-like element, drive means for reciprocating the element, and transmission means whereby the member is responsive to reciprocation of the element to undergo reciprocation along a parallel to the axis of reciprocation thereof.

There are also various utilities for this combination. For example, in the presently preferred embodiments of the invention, the aforementioned reciprocably supported member is driven in this manner, for example, to operate a tool as mentioned, and/or the support for the same.

In many of the presently preferred embodiments of the invention, the member defines a chamber having the piston-like element reciprocably engaged therein to be reciprocated between opposite ends thereof. The drive means for the element include yieldable biasing means on one end portion of the chamber which are operable to displace the element in one direction of reciprocation thereof, and servo-displacement means on the other end portion of the chamber which are operable to intermittently displace the element against the bias of the yieldable biasing means. The transmission means include means on the respective end portions of the chamber which are operable to convert the displacement of the piston-like element in the respective directions thereof, into reciprocable motion on the part of the member in corresponding directions. For example, in certain embodiments, the one end portion of the chamber is closed and the servo-displacement means include means for alternately pressurizing and depressurizing the other end portion of the chamber to displace the piston-like element against a fluid captive in the one end portion thereof. In some embodiments, the servo-displacement means include means for intermittently igniting a combustible charge in the other end portion of the chamber, and means for exhausting the combustion gases from the same when the piston-like element is displaced as indicated. For example, in certain embodiments, the other end portion of the chamber is defined by a combustion engine having a port for exhausting the combustion gases from the same when the piston-like element is displaced as indicated, and means whereby a new combustible charge can be compressed in the other end portion of the chamber when the piston-like element is displaced by the bias of the captive fluid in the one end portion thereof.

In some embodiments, the member has a chuck-like recess in the body thereof, the bottom portion of which is adapted as the aforesaid other end portion of the chamber. A tool is connected with the member in the recess, and the tool has an opposing recess therein which defines the one end portion of the chamber. The piston-like element is slidably engaged in the respective recesses to be reciprocated between the opposite ends thereof.

The invention also relates to a moveably supported member which is reciprocable in relation to its support and which has conjointly reciprocable drive means thereon for reciprocating the same, and means including a port in the body thereof whereby debris can be pneumatically flushed away from the region adjacent the relatively forward end of the member in one direction of the reciprocation thereof. According to the invention, the drive means comprise a combustion engine and the flush means include a connection between the engine and the port whereby the combustion gases can be conveyed to the port as the flush fluid for the debris.

Again, there are also many utilities for this combination. For example, in the presently preferred embodiments of the invention, the reciprocable member has a tool on the relatively forward end thereof which is adapted to generate debris in the region adjacent the end, for example, when it is impacted on a work object at the work station for the same.

In many of the presently preferred embodiments of the invention, the member has a chuck-like recess in the relatively forward end thereof for a tool, and the port is disposed in the recess for connection with fluid discharge means in the tool. In certain embodiments, a tool is connected with the member in the recess which has an intake port that is adapted to communicate with the port in the recess at the connection therebetween. In some embodiments, the tool is rotatably connected with the member in the recess and the connection includes valve means which are operable to prevent the respective ports from communicating with one another during a portion of the rotation of the tool.

The invention also relates to a moveably supported tool which is reciprocable in relation to its support and has a working head at one end of the axis of reciprocation thereof. According to the invention, the head has apertures in the working face thereof that are disposed adjacent the outer peripheral edge of the same, and there are means interconnected with the head whereby a pressurized fluid can be discharged through one portion of the apertures into the region adjacent the face of the head when the tool is generating debris from the work thereof. There are also means on the head which operatively define a relatively low pressure zone at a point relatively rearwardly of the face, and means whereby another portion of the apertures are operatively interconnected with the low pressure zone so that the fluid can transport the debris relatively away from the region through the same.

Once again, there are also may utilities for the foregoing combination. For example, in the presently preferred embodiments of the invention, the aforementioned relatively reciprocable member is often adapted as such a tool, to be used for example, as a means for impacting a work object such as a rock face at a tunnelling site.

In many of the presently preferred embodiments of the invention, there are means for determining the stroke of the tool along the axis of reciprocation thereof, so that the opposing side of the head from the face thereof is spaced apart from the support when the tool is at the limit of its stroke in one direction of reciprocation thereof. Also, the head has a relatively reduced neck on the opposing side of the same from the face, so that a relatively low pressure annulus is formed in the region about the neck, even when the tool is used for tunnelling. The aforesaid other portion of the apertures in the face take the form of axially extending slots in the outer peripheral edge of the same, which open into the annulus at the opposing side of the head.

In some embodiments of the invention, the aforesaid one portion of the apertures is operatively disposed in the bottom portion of the head. For example, in certain embodiments, the tool is rotatably carried in a chuck which is reciprocably mounted in the support, and the fluid discharge means include valve means which are operable to prevent the fluid from communicating with the one portion of the apertures during the upper portion of their field of rotation when the tool is rotated in the chuck. In some embodiments, moreover, the chuck has conjointly reciprocable drive means thereon for reciprocating the same, and the drive means comprise a combustion engine which is interconnected with the fluid discharge means so that the combustion gases can be conveyed to the one portion of the apertures as the pressurized fluid for the debris. Also, in certain embodiments, there are means on the neck whereby the tool is attached to the chuck, and the fluid discharge means include a port in the attachment means which is interconnected with the one portion of the apertures by a fluid flow passage in the body of the head. In some instances, the neck has a shank-like axial extension thereon, and the port in the same is disposed to communicate with a port in the chuck at its interface with the extension.

The present invention also relates to a drill bit which can be used as the foregoing tool. According to the invention, the bit has a head at one end of the drilling axis thereof, the body of which has apertures in the working face thereof. The apertures are disposed adjacent the outer peripheral edge of the head and there are means in the body of the head which are interconnected with one portion of the apertures to discharge pressurized fluid into the region adjacent the face of the head when the bit is generating debris from the drilling action thereof. There are also means on the head which operatively define a relatively low pressure zone at a point relatively rearwardly of the face, and means whereby another portion of the apertures are operatively interconnected with the low pressure zone so that the fluid can transport the debris relatively away from the region through the same.

In the presently preferred embodiments of the invention, there is a relatively reduced neck on the opposing side of the head from the face thereof, and means on the neck whereby the bit can be attached to a chuck so as to form a relatively low pressure annulus in the region about the neck. The aforesaid other portion of the apertures in the face of the head take the form of axially extending slots in the outer peripheral edge of the same which open into the annulus at the aforesaid opposing side of the head. In some embodiments, the slots are deeply radially inset in the body of the head, and are symmetrically angularly arrayed about the face of the head. Moreover, the face of the head is conical and tapers relatively peripherally outwardly from the axis of the bit in the relatively rearward direction thereof. The aforesaid one portion of the apertures take the form of openings which are disposed in the face of the head intermediate the slots. The attachment means takes the form of a shank-like axial extension of the neck.

In many embodiments, the bit has percussive points on the working face thereof, and in some, the points are partially embedded in pads of abrasion resistant material on the face.

In certain embodiments, the bit is adapted to be rotated about the axis thereof and the fluid discharge means take the form of ports which are disposed in the shank-like extension of the neck and interconnected with the one portion of the apertures by fluid flow passages in the body of the head.

The invention also relates to a reciprocably supported member, the support of which is mounted on skids on the ground. According to the invention, the skids are slidably engaged with the ground and there are drive means on the support for reciprocating the member in relation to the same. There are also operatively engagable abutment means on the member and the support, and control means whereby the abutment means can be releasably engaged with one another to tram the support over the surface of the ground on the skids.

The combination also has many utilities. For example, in the presently preferred embodiments of the invention, the member has a rotary drill bit on the relatively forward end thereof, and the drive means are carried on the member and conjointly reciprocable therewith. Also, there are means connected with the bit for entraining the debris generated by the same in a fluid, and means on the support for collecting and discharging the fluid-borne debris relatively rearwardly of the support. Thus, the bit can be used to drill a hole in a work object while the support for the same is trammed into the hole behind the bit, and the debris is removed from the hole rearward of the support.

In many of the presently preferred embodiments, this combination employs certain if not all of the previously described features of the invention as shall be illustrated hereinafter.

The invention also relates to a carriage mounted apparatus for driving a tool or the like at a work station, and/or the carriage relative to the station. There are many useful applications for the apparatus, including that of driving a tunnel excavating tool and/or a carriage for the same, relative to the work face of the tunnel.

According to the invention, the carriage is moveably supported, for example on the ground, and the apparatus comprises a driven member which is moveably mounted on the carriage to reciprocate in relation to the support for the same. The apparatus also comprises means for reciprocating the driven member, first transmission means which are operable to interconnect the driven member with a tool or the like and responsive to reciprocation of the driven member to drive the tool or the like in relation to the carriage support, second transmission means which are operable to interconnect the driven member with the carriage and responsive to reciprocation of the driven member to drive the carriage in relation to its support, and control means which are operable to actuate and deactuate one of the transmission means when the driven member undergoes reciprocation. The apparatus may further comprise means for compensating for momentum lost by the driven member when the one transmission means is actuated; and/or means for compensating for momentum lost by the driven member when the tool or the like is operated through the first transmission means.

In the presently preferred embodiments of the invention, the one transmission means includes an element which is moveably mounted on the carriage and responsive to reciprocation of the driven member to undergo lost motion with respect to the carriage and its support; and the control means are operable to vary the lost motion of the element relative to the carriage, to actuate and deactuate the one transmission means. For example, in certain of the presently preferred embodiments, the second transmission means includes such an element, and the control means are operable to vary the lost motion of the same relative to the carriage, to drive the carriage in relation to its support. In some embodiments, moreover, the first and second transmission means include first and second such elements, respectively, and the control means are operable to vary the lost motion of the same relative to the carriage, to drive the tool or the like in relation to the support when the carriage is driven in relation thereto, and vice versa. In fact, in certain embodiments, the first and second elements are interconnected with one another to undergo such motion in conjunction with one another in response to reciprocation of the driven member, and the control means are operable to vary the lost motion of the same relative to the carriage, alternatively, to drive the tool or the like in relation to the carriage and the support, or to drive the tool or the like and the carriage in relation to the support.

In some of the presently preferred embodiments of the invention, the first and second elements are moveably mounted on the carriage to reciprocate in relation to the carriage and its support. The control means are operable to engage the second element with the carriage when it is desired to drive both the tool or the like, and the carriage, in relation to the support, or alternatively, to disengage the second element from the carriage when it is desired to drive the tool or the like in relation to the carriage and the support.

In certain of these embodiments, the control means include means which are responsive to reciprocation of the driven member to yieldably bias the second element into the disengaged condition thereof relative to the carriage, and servo-control means which are operable to vary the bias on the second element so that it can engage with the carriage when the first element is reciprocated in relation thereto. For example, in some embodiments, the yieldable biasing means include a yieldable biasing member which is interconnected between the carriage and the driven member to tend to cause the second element to disengage from the carriage; and the servo-control means include a yieldably biased control member which is interconnected between the carriage and the driven member to delimit the extent by which the second element disengages from the carriage under the bias of the yieldable biasing member, and means for varying the bias on the control member to engage the second element with the carriage against the bias of the yieldable biasing member when the first element is reciprocated in relation to the carriage.

In certain embodiments, the control member is double-ended and relatively reciprocably interconnected with the carriage and the driven member so that the respective end portions thereof are disposed on opposite sides of the same from the yieldable biasing member. One of the end portions is yieldably biased in one direction of reciprocation of the control member, and the other is reciprocably engaged in a servo-motor which is fluid operated to selectively reciprocate the control member in the other direction of reciprocation thereof against the bias on the one end portion, to engage the second element with the carriage, or alternatively, permit the control member to reciprocate in the one direction thereof under the bias on the one end portion, to disengage the second element from the carriage.

When it is desirable to drive the carriage multidirectionally in relation to its support, as for example, when it is desirable to retract the carriage relatively from a work object on its support, as well as to advance it relatively towards the same, then the second transmission means preferably includes a plurality of spaced elements which are moveably mounted on the carriage and responsive to reciprocation of the driven member to undergo lost motion with respect to the carriage and its support. Also, the control means are operable to vary the lost motion of the elements relative to the carriage, alternatively, to drive the carriage in one direction of its movement, or to drive the carriage in an opposing direction of its movement. In some embodiments moreover, the first transmission means includes a first such element, and the second transmission means includes spaced second and third such elements. The control means are operable to vary the lost motion of the same relative to the carriage, to drive the tool or the like in relation to the support when the carriage is driven in relation thereto, either in the one direction of movement of the carriage, or in the opposing direction of movement thereof. In fact, in certain embodiments, the first, second and third elements are interconnected with one another to undergo such motion in conjunction with one another in response to reciprocation of the driven member, and the control means are operable to vary the lost motion of the same relative to the carriage, alternatively to drive the tool or the like in relation to the carriage and the support, or to drive the tool or the like and the carriage in relation to the support, either in the one direction of movement of the carriage or in the opposing direction of movement thereof.

In some of the multidirectional embodiments, the first, second and third elements are moveably mounted on the carriage to reciprocate in relation to the carriage and its support. The control means are operable to engage the second element with the carriage when it is desired to drive both the tool or the like, and the carriage, in relation to the support, and the carriage in one direction of movement thereof, or alternatively, to engage the third element with the carriage when it is desired to drive both the tool or the like, and the carriage, in relation to the support, and the carriage in an opposing direction of movement thereof, or alternatively, to disengage the second and third elements from the carriage when it is desired to drive the tool or the like in relation to the carriage and the support.

In certain of these embodiments, the control means include means which are responsive to reciprocation of the driven member to yieldably bias the second and third elements into the disengaged condition thereof relative to the carriage, and servo-control means which are operable to vary the bias on the second and third elements so that one or the other of them can engage with the carriage when the first element is reciprocated in relation thereto. For example, in some embodiments, the yieldable biasing means include a yieldable biasing member which is interconnected between the carriage and the driven member to tend to cause the second element to disengage from the carriage and the third element to engage the same; and the servo-control means include a yieldably biased control member which is interconnected between the carriage and the driven member to delimit the extent by which the second and third elements disengage from and engage with the carriage, respectively, under the bias of the yieldably biasing member, and means for varying the bias on the control member either to engage the second element with the carriage against the bias of the yieldable biasing member, or to engage the third element with the carriage under the bias of the yieldable biasing member, when the first element is reciprocated in relation to the carriage.

In certain embodiments, the control member is double-ended and relatively reciprocably interconnected with the carriage and the driven member so that the respective end portions thereof are disposed on opposite sides of the same from the yieldable biasing member. One of the end portions is yieldable biased in one direction of reciprocation of the control member, and the other is reciprocably engaged in a servomotor which is fluid operated to selectively reciprocate the control member in the other direction of reciprocation thereof against the bias on the one end portion to engage the second element with the carriage, or alternatively, permit the control member to reciprocate in the one direction thereof under the bias on the one end portion to engage the third element with the carriage.

In some embodiments, the carriage and driven member have opposing flanges thereon, and the control member is slidably guided in the flanges and equipped with a pair of piston-like heads on the respective ends thereof. The yieldable biasing member is interposed between the flanges, and the bias on the control member is supplied by a second yieldable biasing member which is interposed between one head of the control member and the flange on the carriage. Meanwhile, the servomotor is carried on the flange of the driven member and the other head of the control member is slidably engaged in the chamber of the same.

The first and second mentioned yieldable biasing members are typically resilient compression elements such as coiled springs; and in addition to their aforementioned functions, they also operate to compensate for momentum lost by the driven member when the one transmission means is actuated, and/or to compensate for momentum lost by the driven member when the tool or the like is operated through the first transmission means.

In some embodiments, the first, second and third elements are carried on the driven member, and in certain embodiments, they constitute portions of the driven member. Moreover, in certain of these latter embodiments, the first element portion of the driven member has means thereon whereby an attachment member of a tool or the like can be connected with the same to render the driven member a tool drive member. For example, in some embodiments, the first element portion has a chuck-like recess therein whereby a tool shank or the like can be interengaged with the driven member for this purpose.

In certain of these latter embodiments, the first element portion is adapted so that the attachment member can be rotatably mounted on the driven member, and the driven member has means thereon for rotating the attachment member when the driven member is reciprocated in relation to the carriage and/or its support. In some embodiments, for example, the driven member takes the form of a sleeve, the bore of which is adapted to receive a tool shank that is equipped with means whereby it can be rotatably engaged on the driven member to reciprocate therewith. The means for rotating the shank include a power driven motor means which is carried on the driven member and interconnectable with the shank to rotate the same in the bore of the sleeve when the sleeve is undergoing reciprocation.

In certain embodiments, the sleeve is slidably guided in the carriage, and the second and third element portions of the same take the form of relatively outturned flanges on the opposite end portions of the sleeve, which are engageable with mutually opposing stops on the carriage.

In some embodiments, the carriage is tubular and the sleeve is telescopically engaged in the bore of the same, so that the ends of the carriage form the stops for the flanges of the sleeve.

The means for reciprocating the driven member may be carried on the member and conjointly reciprocable therewith. For example, the driven member may have a piston-like element reciprocably engaged thereon, and there may be drive means on the member for reciprocating the element, and transmission means whereby the member is responsive to reciprocation of the element to undergo reciprocation along a parallel to the axis of reciprocation thereof. In some embodiments, the member has means thereon defining a chamber having the piston-like element reciprocably engaged therein to be reciprocated between opposite ends thereof. The drive means for the element include yieldable biasing means on one end portion of the chamber which are operable to displace the element in one direction of reciprocation thereof, and servo displacement means on the other end portion of the chamber which are operable to intermittently displace the element against the bias of the yieldable biasing means. The transmission means include means on the respective end portions of the chamber which are operable to convert the displacement of the element in the respective directions thereof, into reciprocable motion on the part of the driven member in corresponding directions. For example, in certain embodiments, the one end portion of the chamber is closed and the servo-displacement means include means for alternately pressurizing and depressurizing the other end portion of the chamber to displace the piston-like element against a fluid captive in the one end portion thereof. In some embodiments the servo-displacement means include means for intermittently igniting a combustible charge in the other end portion of the chamber, and means for exhausting the combustion gases from the same when the piston-like element is displaced as indicated. For example, in certain embodiments, the other end portion of the chamber is defined by a combustion engine having a port for exhausting the combustion gases from the same when the piston-like element is displaced as indicated, and means whereby a new combustible charge can be compressed in the other end portion of the chamber when the piston-like element is displaced by the bias of the captive fluid in the one end portion thereof.

In certain embodiments, the apparatus further comprises a tool attachment member which is operatively carried on the driven member to reciprocate in unison therewith, and equipped with means cooperating with the driven member to define the chamber for the piston-like element. In addition, in some embodiments, the attachment member is rotatably carried on the driven member, and the apparatus further comprises means for rotating the attachment member when the attachment member is undergoing reciprocation with the driven member.

In certain embodiments, the driven member has a chuck-like recess therein defining the aforesaid other end portion of the chamber, and the attachment member is connected to the drive member in the recess and equipped with an opposing recess which defines the one end portion of the chamber. The piston-like element is slidably engaged in the respective recesses to be reciprocated between the bottoms thereof.

In some embodiments, the tool attachment member has the tool or the like carried thereon. In fact, in certain embodiments, the tool or the like is fixed on the attachment member. For example, in the case of tunnelling operations or the like, the attachment member often takes the form of a shank which is rotatably engaged on the driven member and equipped with a drill bit that is rotated about the axis of reciprocation of the driven member while being reciprocated in unison with the same.

Where the driven member has a tool or the like thereon which generates cuttings or other debris in the region adjacent the relatively forward end of the same in one direction of its reciprocation, then the apparatus ordinarily further comprises means for removing the debris from said region, such as in the opposite direction of reciprocation of the driven member. For example, in the presently preferred embodiments of the invention, the debris removal means often include means for discharging a fluid through the body of the driven member, to flush the debris from said region; and in many embodiments, the fluid discharge means is operable to discharge the fluid through the body of the tool or the like at the working face thereof. In certain embodiments, the fluid discharge means is operable to discharge the fluid adjacent the outer peripheral edge of the working face; and in some instances, to discharge it intermittently through the face, such as during only a portion of the field of rotation of the tool or the like when the tool is rotatably carried on the driven member and rotated about the axis of reciprocation thereof.

The invention also relates to a reciprocably supported tool which generates debris in the tooling action thereof and which has a moveably mounted debris collecting scoop on the support thereof. According to the invention, there are operatively engagable abutment means on the tool and the scoop, and control means whereby the abutment means can be releasably engaged with one another to move the scoop into debris collecting relationship with the tool.

This combination also has many utilities. For example, in the presently preferred embodiments of the invention, the tool is reciprocably mounted on a carriage and the carriage in turn is mounted on skids on the ground. The skids are slidably engaged with the ground, and the scoop is supported on one or more of the skids. Also, in many of the presently preferred embodiments, the combination further comprises means which are operable to flush the debris into the scoop when it is in debris collecting relationship with the tool, as well as means which are operatively engagable with the scoop to remove the collected debris therefrom from time to time.

The invention also relates to a carriage which is supported on skids on the ground to slide over the surface thereof, and has a tool reciprocably mounted thereon to be engaged with a work object on the ground. According to the invention, there are restraining means on the carriage which are frictionally engagable with the ground to provide a counter thrust for the tool along the axis of reciprocation thereof. There are also means whereby the carriage can be slidably advanced within an opening in the object having surfaces on the opposing sides thereof which are obliquely angled to the horizontal of the earth and means whereby the restraining means can be frictionally engaged with the aforesaid surfaces to wedge the carriage therebetween as a component of the counter thrust.

Once more, there are many utilities. For example, in the presently preferred embodiments of the invention, the carriage advancing means are operable to advance the carriage within a tunnel-like opening in the face of the earth having relatively obliquely angled surfaces in the bottom portion thereof. In fact, the carriage advancing means includes means for excavating a tunnel-like opening in the face of the earth, and means for advancing the carriage within the opening as it is excavated. In certain embodiments, the carriage has a part-cylindrical shoe thereon and the restraining means include spaced restraining elements which are symmetrically disposed on the outer peripheral surface of the shoe to engage the ground. In some embodiments, the restraining elements take the form of pad-like skids which are spaced apart from one another on the surface of the shoe at acute angles to the vertical plane of the axis of reciprocation of the tool.

The invention also relates to a carriage mounted percussive tool for impacting a work object such as the face of a tunnel site. According to the invention, the carriage is moveably supported on the ground and the tool is moveably mounted on the carriage to be reciprocated in relation thereto. Also, there are drive means for reciprocating the tool in relation to the carriage and the ground, and control means whereby the tool can be releasably engaged with the carriage to move the carriage in relation to the ground while the tool is reciprocating in relation thereto.

Again, there are many utilities for this combination. For example, in the presently preferred embodiments of the invention, the tool takes the form of a drill bit and there are means whereby the bit can be rotated about the axis of reciprocation thereof while it is being impacted on the work object, so as to bore a hole therein. Also, the drive means is carried on the tool and conjointly reciprocable therewith so that the carriage and tool unit can be self-advanced as the hole is deepened.

In many of the presently preferred embodiments, the control means include means for determining the stroke of the tool along the axis of reciprocation thereof, and means for shifting the stroke along said axis to releasably engage the tool with the carriage when it is desired to move the carriage in relation to the ground.

In certain embodiments, the combination also comprises means for compensating for momentum lost by the tool when it engages the carriage and/or the work object.

The invention also relates to an earth excavating apparatus wherein there is a member which is moveably supported to be reciprocated in relation to its support and has a conjointly reciprocable excavating tool connected therewith, the working face of which is releasably engagable with the face of the earth in one direction of reciprocation of the member to excavate a portion of the same. According to the invention, there are also means whereby a pressurized fluid can be discharged into the region between the working face of the tool and the face of the earth to fluidize the excavated debris and control means whereby the pressurized fluid can be discharged into said region when the face of the tool is reciprocating in the other direction of reciprocation of the member. There are also means whereby the pressurized fluid can escape from said region through the face of the tool to remove the debris from the same in the aforesaid other direction of reciprocation of the member.

Again there are many utilities. For example, in the presently preferred embodiments of the invention, the fluid discharge means include a device which is operable to generate spaced pulses of pressurized fluid, and the control means include a connection between the device and the tool whereby the pulses are discharged into the aforesaid region when the face of the tool is reciprocated in the other direction of reciprocation of the member.

In many of the presently preferred embodiments, the fluid discharge means include drive means for reciprocating the member in relation to its support. In certain embodiments, the drive means include a combustion engine, the exhaust port of which is connected with the face of the tool to discharge the combustion gases into the aforesaid region. Also, in some embodiments, the engine is carried on the member and conjointly reciprocable therewith.

In certain embodiments, the fluid discharge means include apertures in the face of the tool which open into the aforesaid region between the face of the tool and the face of the earth. The fluid escape means include apertures in the face of the tool which open into a relatively low pressure zone on the opposite side of the tool from the working face thereof.

In some embodiments, the tool is mounted to be reciprocated along a generally horizontal axis and there are means for preventing the discharge of the fluid into the aforesaid region in the relatively upper portion of the face of the tool. For example, in certain embodiments, the tool is rotatable about the axis of reciprocation thereof, and the fluid discharge prevention means are operable to prevent the fluid from discharging into the aforesaid region during the relatively upper portion of the field of rotation of points on the face.

In some embodiments, the tool is carried on the member and the support for the same takes the form of a carriage which is supported on skids on the ground to slide over the surface thereof. The apparatus also comprises means whereby the carriage can be slidably advanced along the surface of the ground when the tool is releasably engaged with the face of the earth in the one direction of reciprocation of the member. Also, the carriage has scoop-like means thereon which are disposed to receive the debris when the carriage is advanced in the one direction of reciprocation of the member and the pressurized fluid escapes from the aforesaid region through the face of the tool.

In certain embodiments, there are restraining means on the carriage which are frictionally engageable with the ground to provide a counter thrust for the member along the axis of reciprocation thereof. There are also means whereby the carriage can be slidably advanced within an opening in the face of the earth having surfaces on the opposing sides thereof which are obliquely angled to the horizontal of the earth, and means whereby the restraining means can be frictionally engaged with the aforesaid surfaces to wedge the carriage therebetween as a component of the counter thrust.

The invention also relates to a method for excavating a hole in the face of a tunnel site. According to the invention, a carriage is moveably supported on the ground adjacent the face of the site, and a percussive tool is moveably mounted on the carriage to be reciprocated in relation to the carriage and the ground. The tool is reciprocated in relation to the same to impact it on the face of the site, and is rotated about the axis of reciprocation to bore a hole in the face. In addition, the tool is releasably engaged with the carriage to move the carriage in relation to the ground while it is impacted on the face of the site. In this way the tool advances the tool and carriage unit into the hole as it is deepened.

In certain embodiments the carriage is frictionally engaged with the ground to provide a counter thrust for the percussive action of the tool. However, the carriage is preferably supported on skids on the ground so that it can be trammed over the surface of the same.

BRIEF DESCRIPTION OF THE DRAWINGS

These features will be better understood by reference to the accompanying drawings wherein the invention is illustrated in terms of its application to a carriage mounted tunnel excavating apparatus.

In the drawings.

DESCRIPTION OF THE PREFERRED EMBODIMENT

Figure 1:
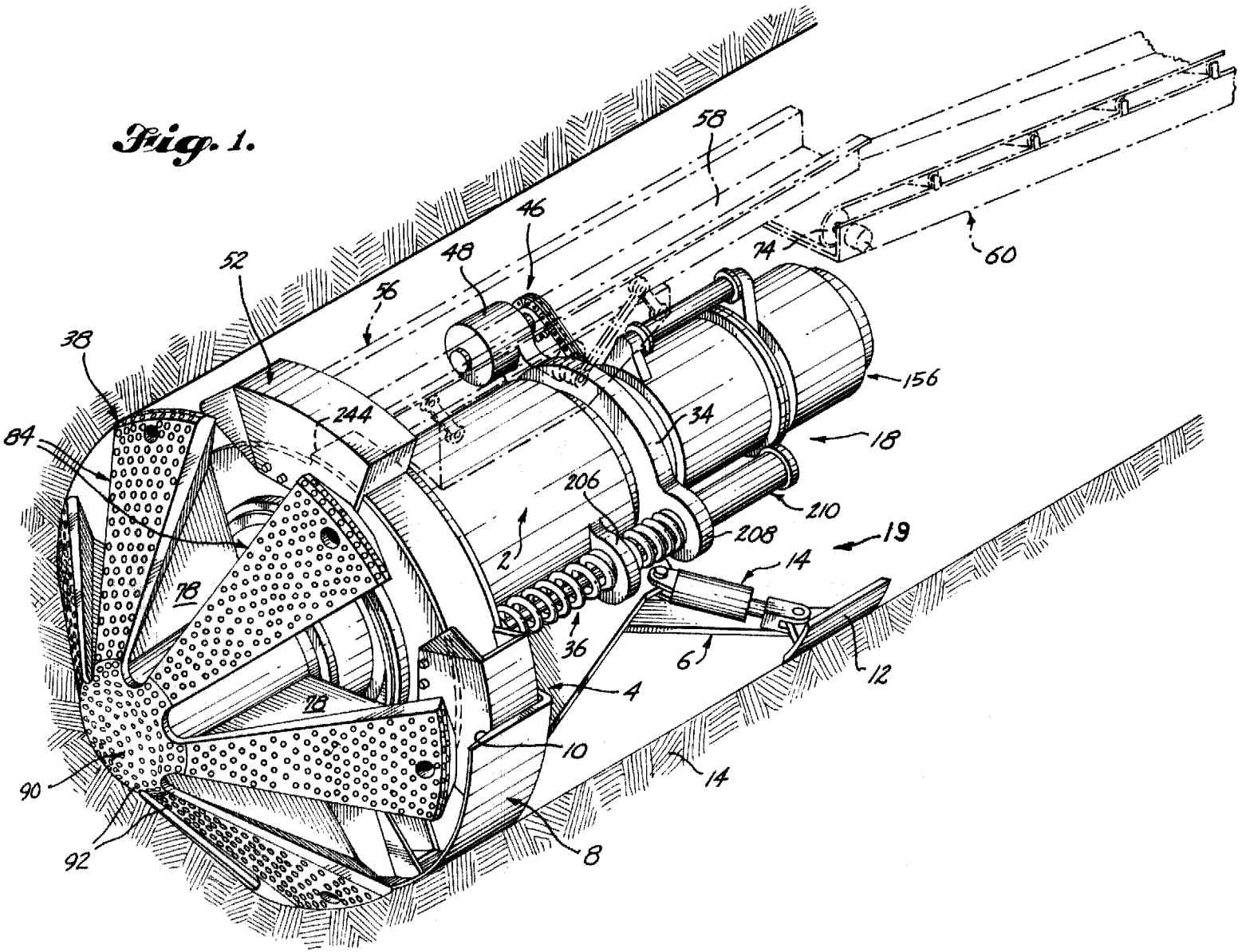
FIG. 1 is a perspective view of the apparatus when it is put in use in a tunnelling operation.
Figure 2:
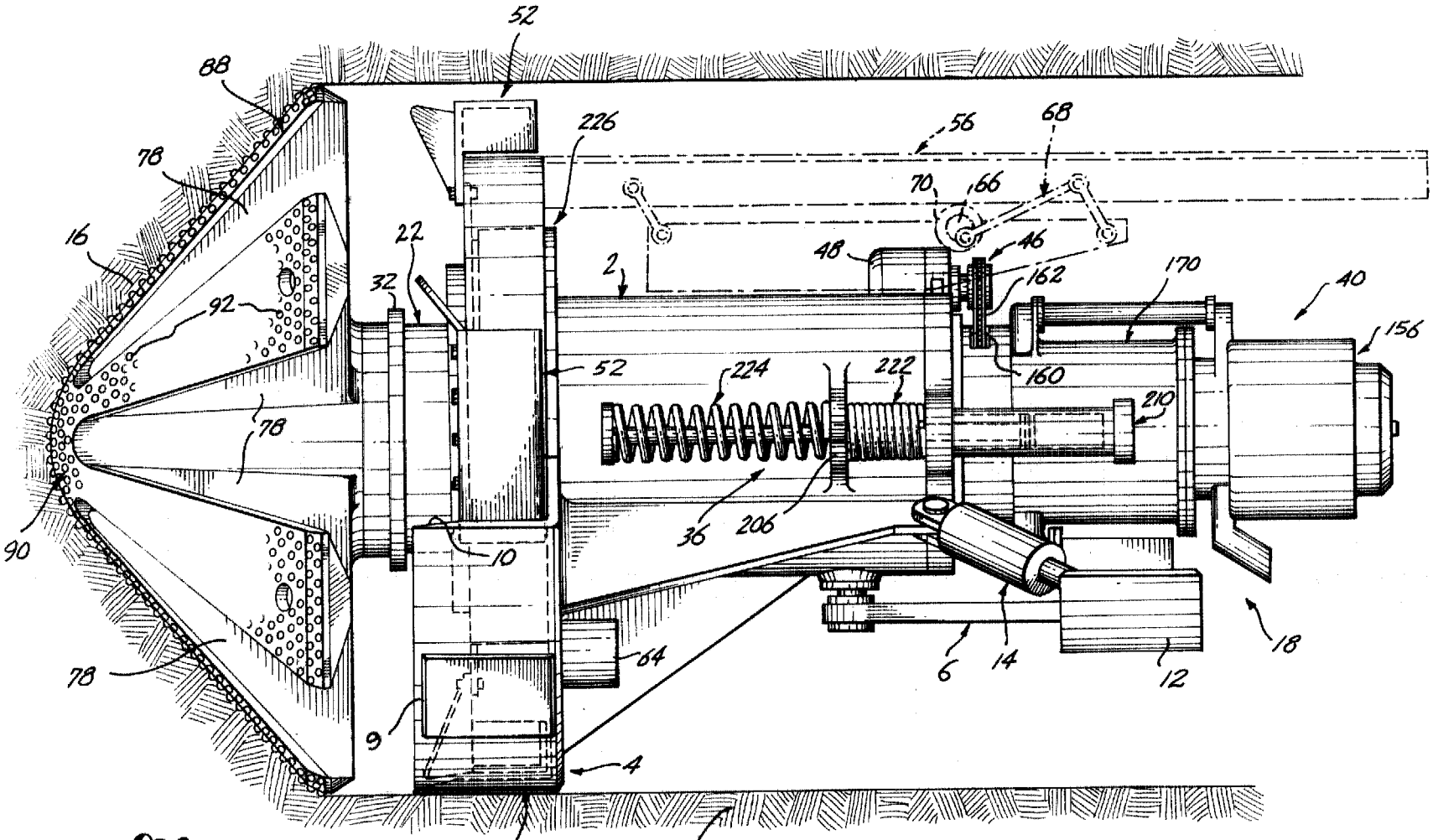
FIG. 2 is a side elevational view of the apparatus in use.
Figure 3:
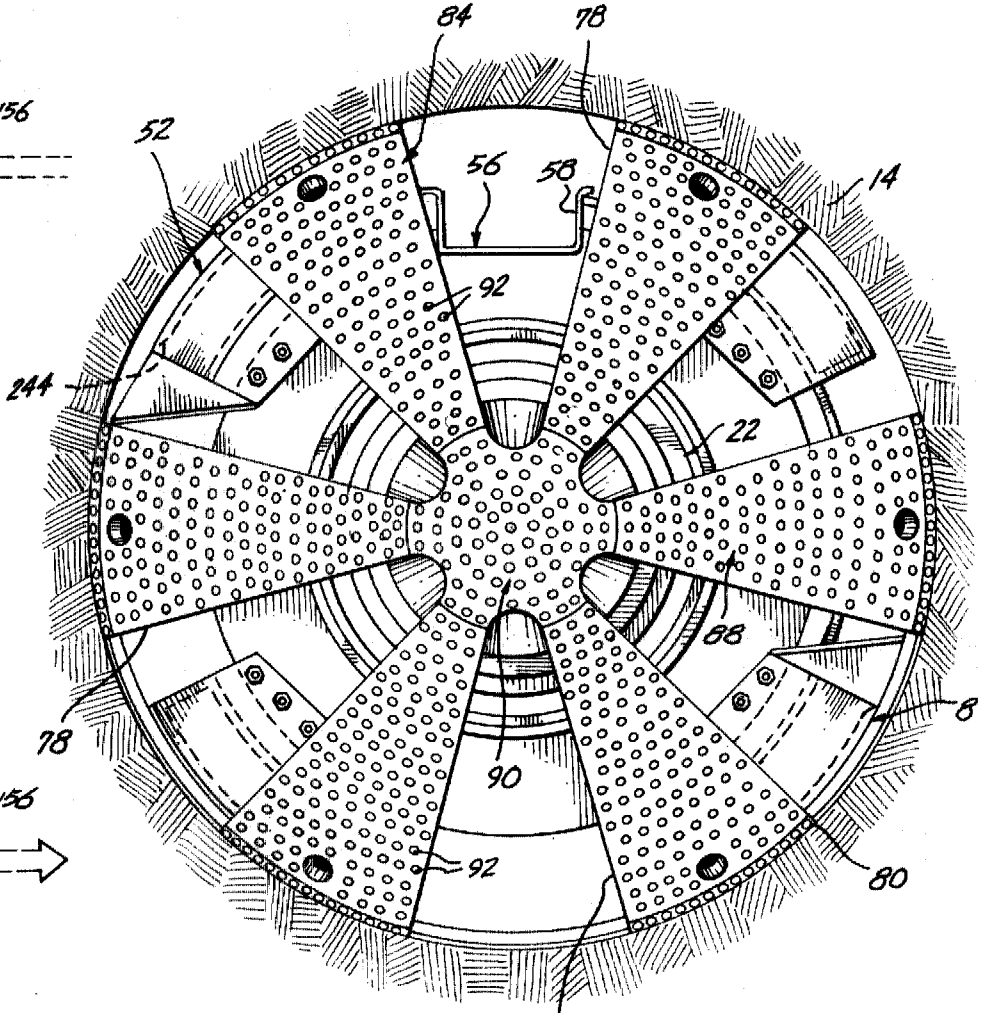
FIG. 3 is a front elevational view of the same.

Referring to the drawings, it will be seen that the apparatus 18 is mounted on a carriage 19 which comprises a tubular frame 2 that is supported on three skid-mounted struts 4 and 6. The more forward strut 4 is a rigid bibb-like extension of the frame and has a part-cylindrical shoe 8 at the bottom thereof, the inner periphery of which is tapered at the leading edge 10 thereof to form a scoop. The bottom of the shoe is equipped with a pair of pad-like skids 9. See FIG. 2 in particular. The more rearward struts 6 are pivotally adjustable leg-like extensions of the frame, and have pad-like skids 12 on the bottoms thereof which are interconnected with the frame by hydraulic cylinders 14 so that the struts 6 can be adjustably angled to the frame. Both pairs of skids 9 and 12 are slidably engaged with the ground 14 so that the carriage can be "trammed" over the surface thereof, either in the direction of the working face 16 of the tunnel, or in the opposite direction relatively away therefrom.

The apparatus 18 is telescopically engaged in the axial bore 20 of the frame 2, and comprises a combination chuck and drive transmission sleeve 22 which is slidably engaged in the frame so that it can reciprocate along the axis 24 thereof, but not rotate in relation to it. See the spline 26 which is interposed between circumferentially opposing grooves 28 and 30 in the outer and inner peripheries of the sleeve and the frame, respectively. Note also that the reciprocable motion of the sleeve is delimited by a pair of out-turned flanges 32 and 34 on the opposite ends thereof. These flanges operate as "transmissions" for transmitting driving forces into the carriage when it is desired to tram the same relative to the face of the tunnel, as shall be explained. They are actuated and deactuated in this connection by a pair of conjointly operable control devices 36 on the carriage, as shall also be explained. The control devices are best seen in FIGS. 1,2,4,7 and 8.

The tunnelling operation itself is performed by a drill bit 38 which is carried on the sleeve 22 and assembled with the same so that it can be rotated about the axis 24 of the carriage while being reciprocated in unison with the sleeve. The reciprocable motion is generated by a drive mechanism 40 which is disposed on the rear end portion of the assembly 38, 22. The drive mechanism is powered by a two-cycle diesel engine 42 which transmits the driving forces through a piston 44 in the assembly, as shall be explained.

The bit 38 is rotated by a motor driven chain and sprocket drive transmission 46 on the assembly. The motor of the same can be seen at 48.

When the apparatus 18 is put to use, the bit 38 generates excavated debris, and the debris is flushed through the working face 50 of the bit in a manner to be explained. Meanwhile, the carriage is trammed toward the face 16 of the tunnel so that the debris tends to collect in the shoe 8 thereof. Also, the collected debris is continually removed by a conventional muck-bucket-type collection device 52 which is rotatably mounted on a boss 54 at the forward end of the carriage frame. The device 52 rotates about the inner periphery of the shoe 8, scoops up the collected debris, and raises it onto a link-supported vibrating trough conveyor 56 above the carriage. The debris is then discharged from the trough 58 of the conveyor onto a belt conveyor 60 adjacent the rear end of the apparatus.

The muck collection device 52 is rotated by a motor driven ring gear transmission 62 mounted at the rear of the same between the boss 54 and the shoe 8. The motor of the same can be seen at 64. The conveyor 56 is vibrated by a motor driven crank 66, which is interconnected with the trough 58 of the same by an articulated linkage 68. The motor for the crank can be seen at 70. The belt conveyor 60 is rotated by a motor which is not shown but is connected with one roller of the same to drive the belt about the idler 74.

Referring to the drawings now in greater detail, it will be seen that the bit 38 is conical at the working face 50 of its head 76, and is slightly greater in diameter than the perimeter of the shoe 8. The body of its head is subdivided, however, by a series of symmetrically angularly spaced, deeply radially inset slots 78 at the outer peripheral edge 80 thereof. The slots 78 open into the back side 82 of the head, and divide the head into symmetrically angularly spaced segments 84 that merge with one another at the flattened tip 86 thereof. Each of the segments 84 is covered by a replaceable pad 88 of studded abrasive resistant material which is adapted for drilling hard rock. The tip 86 is also covered by such a pad, but in this instance, the pad 90 is rounded, rather than flat. All of the pads are equipped with a multiplicity of percussive studs 92 which are embedded in the abrasive resistant material to project from the face of the bit at perpendiculars thereto.

At the back side 82 of its head, the bit is conically chamferred at the edge 80 thereof, and equipped with a relatively reduced shank 94 that is sufficiently elongated to pass through the length of the sleeve 22. The body of the shank has a rearwardly oriented shoulder 96 thereon adjacent the head, and the inside edge of the shoulder is formed into a cylindrical neck 98. The neck is followed in turn by an annular groove 100 which is disposed about the midsection of the body and terminates at the tail 102 of the shank. The tail 102 is cylindrical and somewhat reduced in diameter relative to the neck 98, and the groove 100 tapers inwardly toward the same in the rearward direction of the shank. The tail is also equipped with an annular groove 104 of considerably narrower width than the groove 100.

The bit 38 also has a series of ports 106 in the head thereof, which are symmetrically angularly arrayed about the face of the head to open through opposing apertures 108 in the outer peripheral portions of the pads 88 thereon. The ports are serviced by a corresponding series of circumferentially spaced ports 110 in the neck 98 of the shank. The ports 110 open into a corresponding series of passages 112 which extend forwardly through the neck to the head, and then extend radially outwardly thereof to the ports 106.

The bit also has an axial bore 114 in the rear end 116 thereof. The bore extends forwardly through the length of the shank and into the head of the bit, where it terminates at a point short of the pad 90 on the tip of the same. The bottom of the bore, that is, the head end portion 118 thereof, is radially enlarged to assume a greater diameter than that of the main length of the bore.

Referring now to the sleeve 22, it will be seen that the axial opening 120 of the same has a stepped configuration therein so that the sleeve can be rotatably interengaged with the neck 98 and the tail 102 of the bit when the shoulder 96 of the bit is abutted against the front end face 122 of the sleeve. The tail 102 projects beyond the rear end face 124 of the sleeve, however, as indicated, and to an extent that the groove 104 in the tail registers with the face 124. The stepped configuration includes a bore 126 which is countersunk in the forward end of the opening 120, and extends to a depth commensurate with the relatively rear end edge 128 of the groove 100 in the midsection of the shank. It also includes a slightly larger bore 130 which is countersunk in the relatively forward end portion of the bore 126, and extends to a depth commensurate with the relatively forward end edge 132 of the groove 100. As seen, the larger bore 130 is sized to rotatably engage with the neck 98 of the bit, whereas the original opening 120 in the sleeve is sized to rotatably engage with the tail 102 of the same. Meanwhile, the smaller bore 126 defines an annular passage 134 at the interface between the sleeve and the midsection of the shank. The passage is cone-shaped in length and terminates at the forward end edge 132 of the groove 100 in the shank of the bit. However, the passage is operatively interconnected with the ports 110 in the neck of the bit by a part-annular circumferential groove 136 in the bottom of the sleeve 22, which is opposed to the shoulder 138 between the neck and forward end edge 132 of the groove 100.

The sleeve 22 also has an inlet port 140 in the outer periphery thereof, whereby fluid can be supplied to the ports 110 in the neck of the bit, when the ports are rotating through the lower half of their field of rotation. The inlet port is disposed on the perimeter of the relatively rear end flange 34 of the sleeve, and opens into a passage 142 in the body of the sleeve. The passage opens in turn into the bore 126 of the sleeve through a port 144 in the top thereof. The fluid may be supplied to the inlet port by an external supply system, such as a compressed air supply system (not shown); or it may be supplied to the inlet port by the diesel engine 42 of the drive mechanism 40 on the bit and sleeve assembly, as shall be explained shortly.

Figure 5:
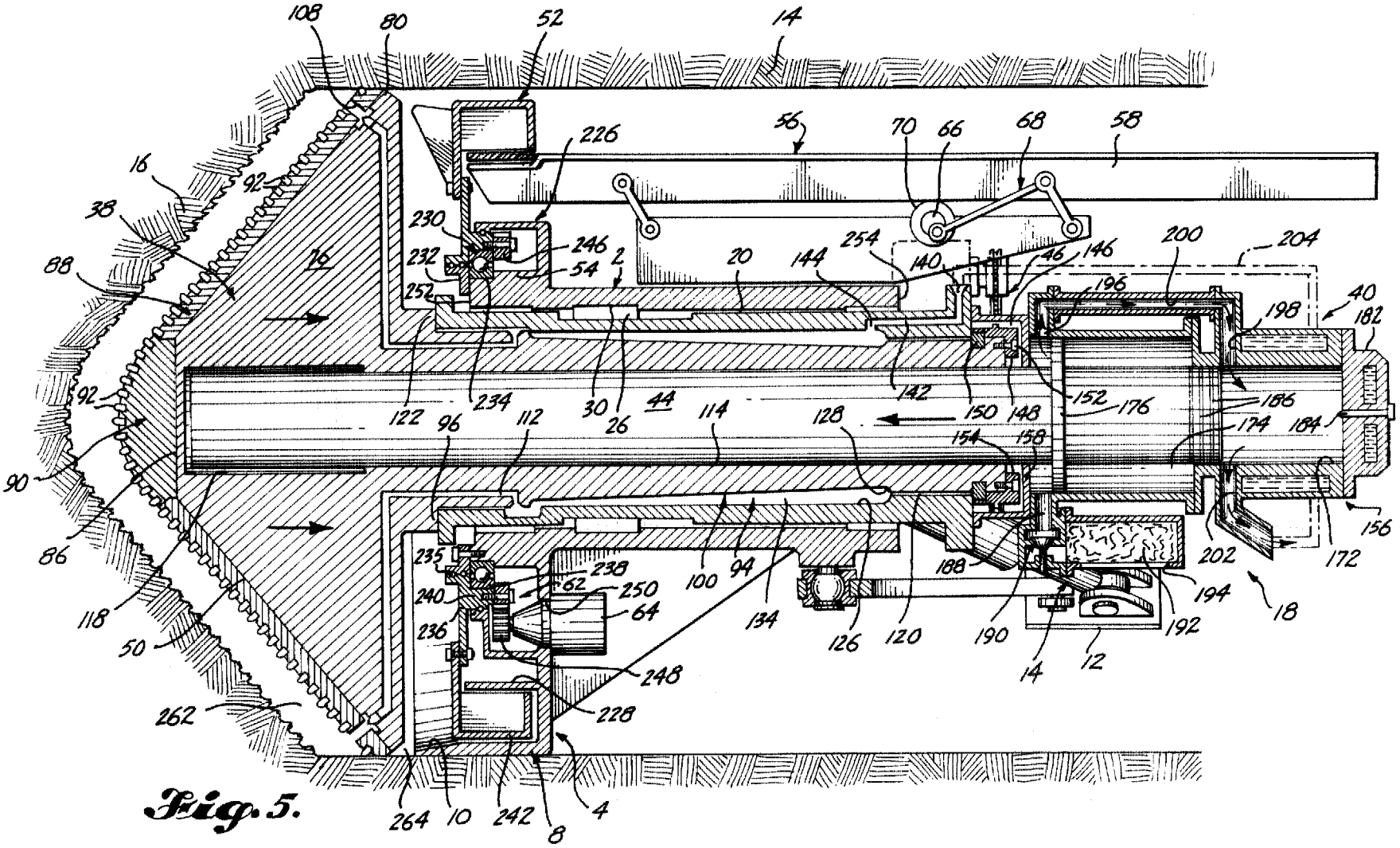
FIG. 5 is a longitudinal cross-sectional view of the apparatus when the driven member of the apparatus is approaching the rearward limit of its stroke.
Figure 6:
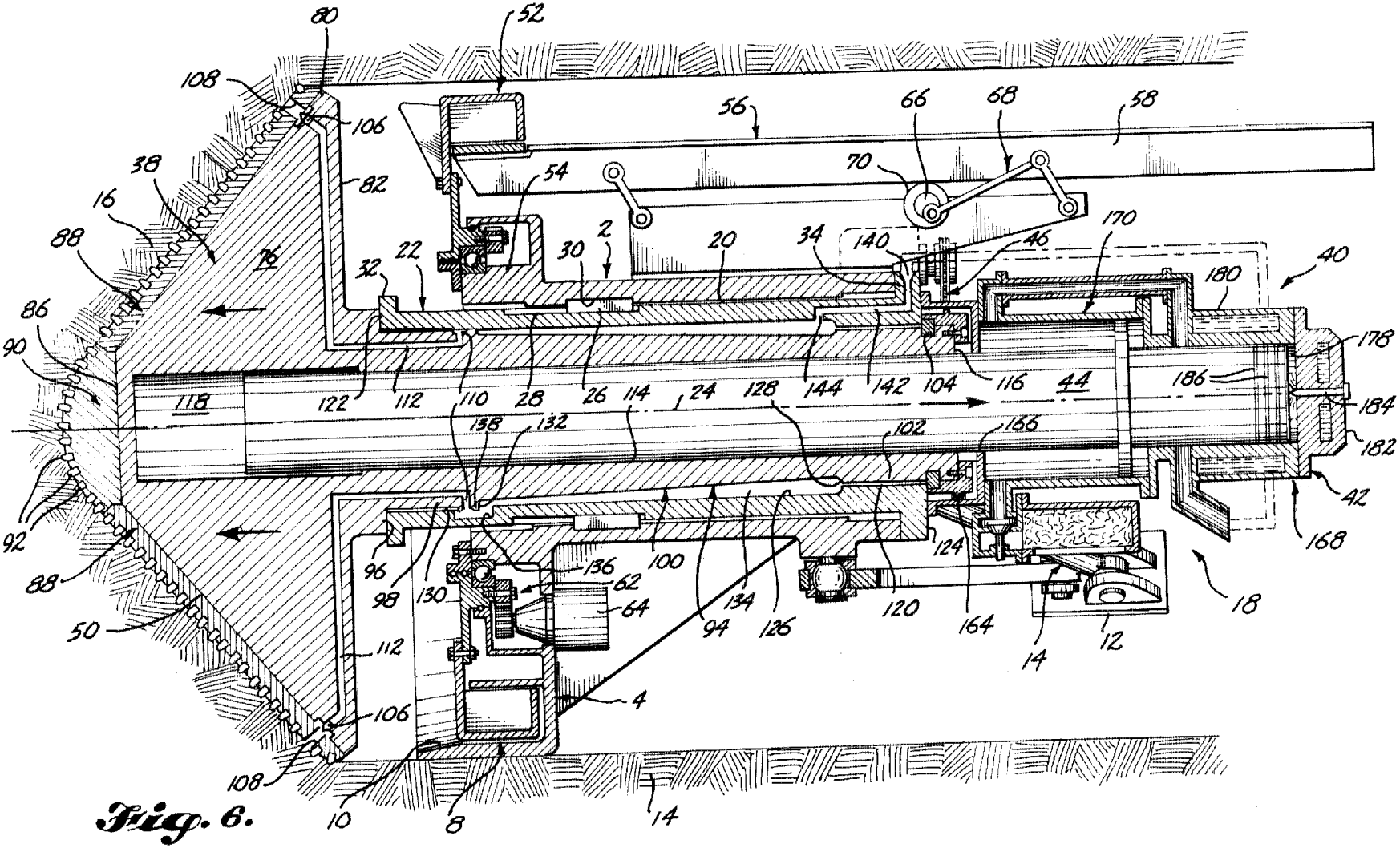
FIG. 6 is a similar view of the apparatus when the driven member is at the forward limit of its stroke.

Referring to the right hand side of FIGS. 5 and 6 in particular, it will be seen that the bit is assembled with the sleeve, and vice versa, by securing the sprocket 146 of the drive transmission 46 on the tail 102 of the same. The hub 148 of the sprocket is apertured and rabbeted to fit over the end of the tail. It is also sized so that the bit can rotate within the sleeve when the sleeve is interengaged between the hub and the shoulder 96 of the bit. Also, the rabbet in the hub 148 is countersunk at the forward end thereof, to receive a thrust ring 150 which is interposed in the groove 104 of the bit across the joint between the hub and the sleeve. Cap screws 152 are employed to secure the sprocket to the bit, and the aperture 154 in the hub of the same is of such diameter as to freely pass the piston 44 of the reciprocable drive mechanism 40.

The engine 42 is enclosed within a two-part housing 156 which has a cap 158 for the sprocket 146 at the base thereof. The cap is affixed to the rear end 124 of the sleeve, and has a part-annular circumferential slot 160 in the top thereof through which the chain 162 of the drive transmission 46 is passed to the toothed perimeter 164 of the sprocket. It also has a central aperture 166 therein which corresponds to the bore 114 of the bit in diameter. The piston 44 is elongated and slidably engaged in the aperture 166 and the bore 114 to project within the interior of the housing components 168 and 170. The components in turn have a pair of axially aligned chambers 172 and 174 therein for the piston. The chamber 172 of the relatively rearward component 168 is adapted to slidably receive the body of the piston, whereas the chamber 174 of the relatively forward component 170 is adapted to slidably receive an annular flange 176 on the rear end portion of the same. The flange and the front portion of the relatively forward chamber 174 serve as a pump for the fresh air supply to the engine, while the head end portion 178 of the relatively rearward chamber 172 serves as the combustion chamber thereof. The surrounding wall 180 and head 182 of the combustion chamber 178 are liquid cooled, and a nozzle 184 is installed in the head 182 of the same for the injection of fuel into the chamber. The fuel is intermixed with the fresh air, and the mixture is ignited in conventional manner. The start-up ignition means are not shown for the sake of simplicity.

A plurality of seal rings 186 are recessed about the rear end portion of the piston.

The relatively forward chamber 174 has an inlet port 188 in the wall thereof, through which the fresh air is intaken by the pump. The inlet port has a check valve 190 across the same to allow the air to enter the chamber when the pump creates a pressure differential across the valve in the direction inwardly of the chamber, but to prevent air flow in the opposite direction when the pump creates a reverse differential thereacross. The incoming air is cleansed by an air filter 192 at the inlet 194 of the valve, and is displaced from the chamber 174 through an outlet port 196 in the wall thereof, diametrically opposed to the inlet port 188. The outlet port is interconnected with a third port 198 in the forward end of the combustion chamber 178, by a duct 200 on the outside of the housing 156. The third port is diametrically opposed in turn by an exhaust port 202 on the opposite side of the combustion chamber at the forward end thereof. The exhaust port is connected in turn to the inlet port 140 of the sleeve 22 by a flexible hose 204 or the like, and the connection is valved so that the combustion gases can be selectively discharged to atmosphere, or to the port 140, depending on the stage in which the apparatus is being operated, as shall be explained.

Referring now to FIGS. 1,2,4,7 and 8 in particular, it will be seen that the carriage frame 2 has a pair of angularly spaced ears 206 upstanding thereon at the top thereof, and that there is a pair of similarly upstanding ear-like extensions 208 on the rearend flange 34 of the sleeve. The respective extensions are axially aligned with the ears of the carriage, and are equipped with a pair of hydraulic-cylinder-type servomotors 210 on the rear end faces thereof. Each servomotor has a piston-like control member 212 slidably engaged in the chamber 214 thereof, and each control member comprises a rod 216 having a pair of piston-like heads 218 and 220 on the opposing ends thereof. The rod is slidably guided in the respective extension 208, and the ear 260 thereopposite, and one head 48 of the same is slidably engaged in the chamber 214 of the respective servomotor as indicated. The other head 220 is spaced outboard from the corresponding ear, and a pair of coiled springs 222 and 224 is caged about the rod between the ear 206 and the extension 208, on one hand, and between the ear and the outboard head 220, on the other. The springs operate to compensate for momentum lost by the bit and sleeve assembly 38, 22 when it is used in tramming the carriage and/or excavating the tunnel, as shall be explained; whereas the servomotors enable the effect of the springs to be altered for purposes of actuating and deactuating the tramming effect, as shall also be explained.

Referring now to FIGS. 1,2,4,5 and 6 in particular, it will be seen that the boss 54 on the forward end of the carriage frame 2 has an annular housing 226 thereabout, which opens to the front of the apparatus. Also, there is a part-annular muck ring 228 connected upright about the front of the bibb-like strut 4, at a diameter intermediate that of the housing 226 and that of the shoe 8. A ball bearing ring 230 is seated on the boss at the mouth of the housing, and is held in place by an annular bushing 232 which is secured to the forward end of the boss. The bushing registers with the inner race 234 of the bearing, and together with the same, forms a journal 235 for an annular disc 236 which is rotatably mounted on the outer race 238 of the bearing. The disc has a hub 240 and four lipped, side loading muck buckets 242 symmetrically angularly arrayed about the outer periphery thereof. The buckets are rotatably interengaged between the inner periphery of the shoe 8 and the muck ring to collect the debris on the bottom of the strut 4. The debris is then transported in conventional fashion to the terminal edge 244 of the muck ring at the top thereof. See FIG. 1. The hub 240 has the gear 246 of the transmission 62 secured to the rear face thereof, and the gear is driven by a spur gear 248 on the motor 64 of the transmission. The motor is mounted within an aperture 250 in the strut 4.

When the apparatus 18 is put to use, initially the piston 44 is put into motion by operating the servomotors 210 as double-acting cylinders; or by pumping charges of compressed air into the head end portion 118 of the bore 114 in the bit. Either approach has the effect of generating relative motion between the piston and the bit and sleeve assembly, so as to enable the engine 42 to be started. Once the engine is running, successive fuel-air mixtures can be compressed and ignited in the combustion chamber 178 of the same to operate the engine in conventional fashion. Moreover, each cycle of the engine displaces the piston forwardly from the chamber, and the resulting forward motion of the piston operates to compress the air trapped in the head end portion 118 of the bore 114, as well as to compress the air ahead of the piston flange 176 in the pump chamber 174. The latter effect operates to force a new fresh air charge into the combustion chamber through the duct connected ports 196 and 198. The new charge floods the chamber, and in doing so, displaces the residual combustion gases through the exhaust port 202. Meanwhile, the trapped air in the head end portion 118 of the bore 114 operates as a yieldable biasing medium, and when the accumulated pressure of the same overcomes the motion of the piston, the piston is reversed and driven in the opposite or rearward direction of the bore. As the piston returns to the combustion chamber, the flange 176 on the same opens the ports 188 and 196 and generates a suction condition in the pump chamber 174. This opens the valve 190, and a new charge of air is intaken through the inlet 194 of the same. The piston is then redisplaced in the forward direction of the bore by the ignition of a new fuel-air charge in the combustion chamber, and the operation is repeated again and again to cause the piston to reciprocate within the bit and sleeve assembly.

As the piston reciprocates, it generates the same motion in the assembly 38, 22 itself, inasmuch as the piston alternately compresses the air masses at the forward and rearward ends, 118 and 178 respectively, of the assembly. The dynamics of the resulting motion on the part of the assembly are controlled in part by a throttle on the engine, which for the sake of simplicity is not shown. However, the useful application of these dynamics is determined more by the effect of the control devices 36, which as explained, are interposed between the carriage and the reciprocating assembly.

Referring now to FIGS. 1,2 and 4 through 9 in particular, it will be seen that when the engine is underway, the stroke of the bit and sleeve assembly works against the bias of the respective pairs of springs 222 and 224 in the devices 36. This being the case, the energy stored in each spring pair operates to effectively restore any momentum lost by the assembly as it reciprocates counter thereto. In addition, the relative biases of the respective spring pairs operate to locate the stroke of the assembly along the axis 24 of the carriage. That is, the net differential between the biases determines where the stroke can take place on the axis; and this being the case, it is also true that the net differential can be used to relocate the stroke, that is, to shift it to a new location on the axis without diminishing or enlarging the length of the same.

According to the invention, the servomotors 210 are operated to vary the differential for this purpose, and particularly in the sense of either locating the stroke of the assembly so that the flanges 32 and 34 of the same clear the stops constituted by the forward and rear end faces 252 and 254 of the carriage frame 2, or shifting the stroke so that one or the other of the flanges engages the corresponding stop on the carriage frame. The servomotors are operated in this way, moreover, to create several conditions with respect to the operation of the apparatus itself. For example, they may be operated to reciprocate the assembly in relation to the carriage and the ground 14 without engaging the work face 16 of the tunnel. In such a case, the assembly can be said to be undergoing lost motion with respect to both the carriage and its support, i.e., the ground. Alternatively, they may be operated to reciprocate the assembly in engagement with the face of the tunnel while it is undergoing lost motion with respect to the carriage. In such a case, they are being used simply to enable the assembly to drive the tool constituted by the bit 38 without advancing (or retracting) the carriage at the same time. However, in this case, it is apparent that the tunnelling operation can progress no further than the head 76 of the bit can reach into the face of the tunnel. Therefore, for a prolonged operation, it is necessary to operate the servomotors in the sense of reciprocating the assembly in engagement with both the carriage and the face of the tunnel, either simultaneously or alternatively, or both. Of course, the control devices 36 provide this capability since they can vary the stroke of the assembly to drive the carriage alone, for example, when the carriage is standing off from the face of the tunnel at such distances that the head of the bit can not reach the same; or they can vary the stroke of the assembly to drive both the carriage and the bit, for example, when the head of the bit is within operative reach of the face of the tunnel.

Figure 7:
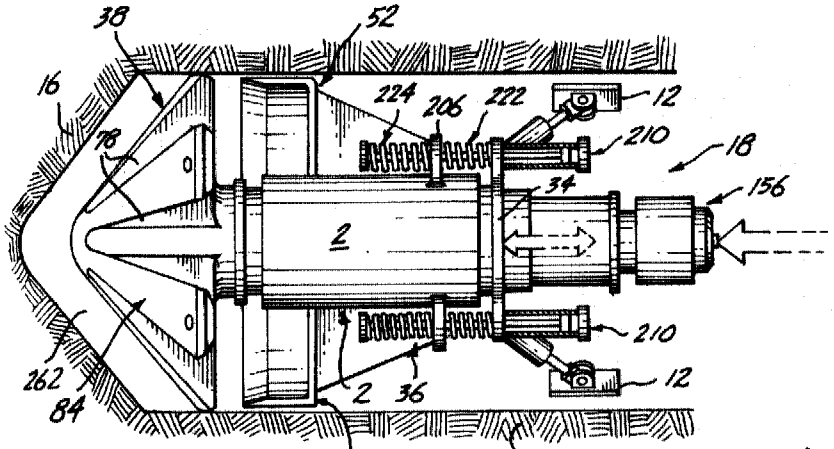
FIG. 7 is a schematic representation of the apparatus when it is put to use in a tunnelling operation.
Figure 8:
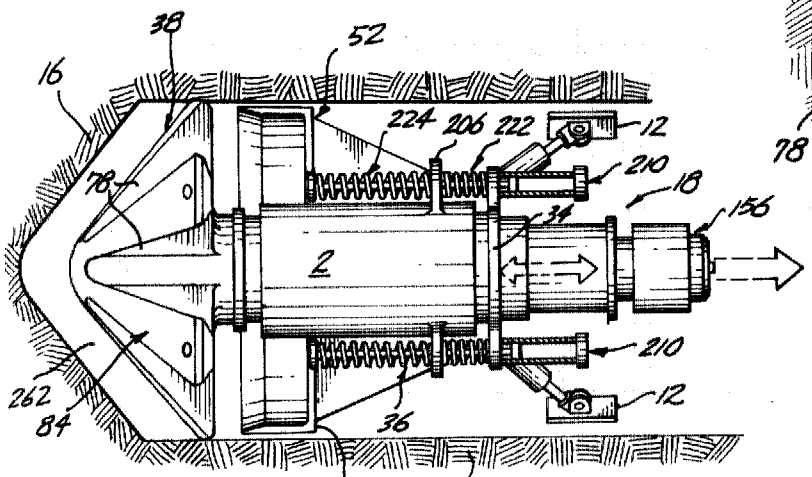
FIG. 8 is a schematic representation of the apparatus when it is put to use in a tunnelling operation, but being retracted from the tunnel.
Figure 4:
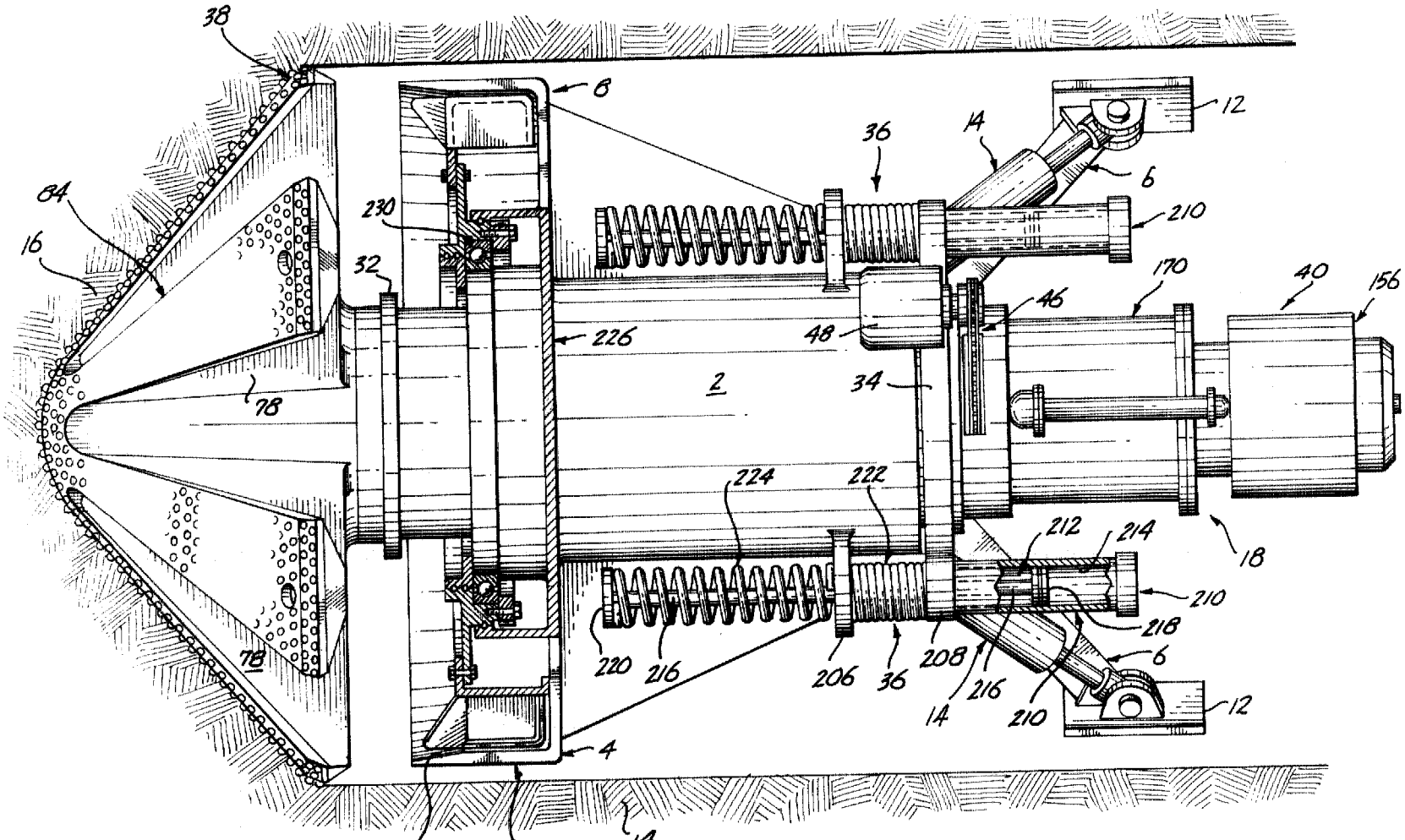
FIG. 4 is a top plan view of the same.
Figure 9:
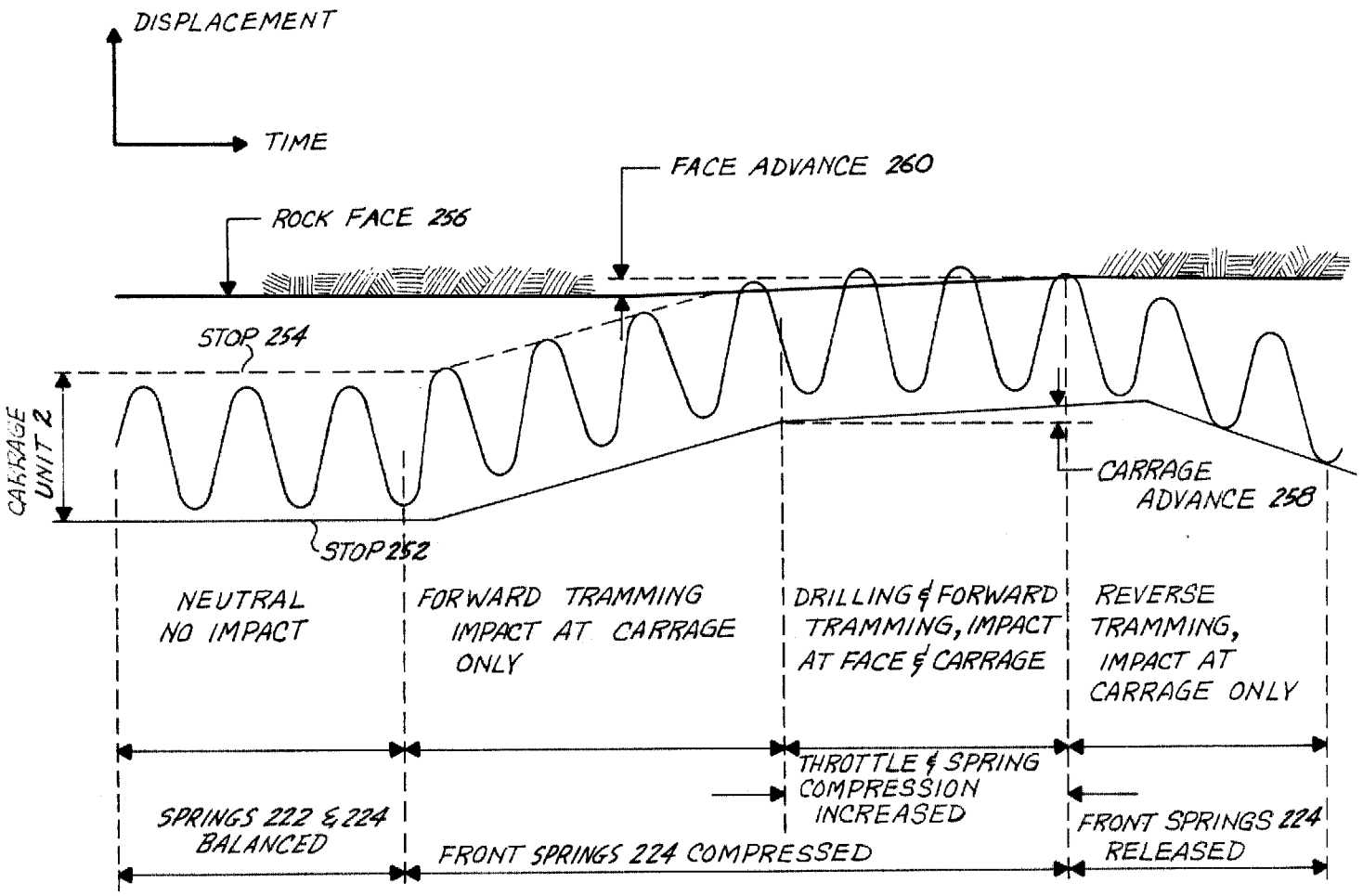
FIG. 9 is a diagramatic representation of the two successive operations, starting with the neutral condition of the apparatus.

Referring now to FIGS. 7-9, and to FIG. 9 in particular, it will be seen that these possibilities are schem atically and diagramatically illustrated in terms of a typical rock drilling operation. Initially, at the left hand side of the diagram in FIG. 9, the springs 222 and 224 of the control devices 36 are balanced and the apparatus is standing off from the rock face 256 of the tunnel at such distance that the bit and sleeve assembly can achieve no impact on either the face 256 or the carriage 2. This is the neutral condition of the assembly in that it is undergoing lost motion with respect to the ground, the face and the carriage. However, moving to the right on the diagram, it will be seen that the servomotors 210 can be operated to cause the outboard heads 220 of the control members 212 to compress the front springs 224 of the devices to the point where the rear end flange 34 of the assembly will impact the carriage at the rear end stop 254 thereof and cause the carriage to tram forward toward the rock face. Subsequently, as the bit 38 approaches the face, the engine 42 can be throttled to give it more power, and the compression on the springs 224 can be increased to compensate for the impact of the bit on the face. Meanwhile, the assembly can continue to impact the carriage for purposes of advancing it into the face as the drilling operation proceeds therein. The advance of the bit is schematically indicated at 258, whereas the corresponding carriage advance is indicated at 260. Should it become necessary or desirable to reverse the direction of the carriage, such as to retract it from the tunnel, the servomotors 210 can be operated to release the front springs 224 to the point where the springs 222 and 224 are unbalanced in the opposite direction and the front end flange 32 of the assembly is caused to impact the carriage and produce reverse tramming of the same away from the rock face.

When the apparatus 18 is at the rock face, the motor 48 is normally operated to rotate the bit. Also, the motors 64 and 70 are actuated and the connection 204 between the exhaust port 202 of the engine and the inlet port 140 of the sleeve is opened to discharge the combustion gases through the ports 106 in the head of the bit as the ports rotate through the bottom half of their field of rotation. The timing is such that the "pulses" of combustion gas discharge through the ports when the face of the bit is reciprocating in the direction relatively away from the face of the tunnel. As a consequence, the discharged gases enter the region between the faces when there is a gap 262 opened to them, and once in the gap, they effectively fluidize and entrain the excavated debris at the toe of the gap and then escape back through the slots 78 in the bottom half of the bit to remove the debris from the gap. Moreover, when the face of the bit is reciprocated in the opposite direction on the next stroke of the bit, i.e., toward the face of the tunnel, the gases in the gap are "pumped" and recompressed by the face of the bit in the manner of a bellows to maintain the flow of debris through the slots of the bit. Meanwhile, the displaced debris enters the relatively low pressure annulus 264 behind the head of the bit, and deposits on the inner periphery of the shoe 8, where it is promptly removed by the buckets 242 of the muck collection device rotating therewithin. The continual forward movement of the shoe also lends itself to this effect, in much the same manner as one must continually "scoop" a dust pan forward when it is used in cooperation with a whisk broom, if he is to achieve the maximum effect on the part of the broom.

Each bucket of the muck collection device lifts a portion of the debris upward about the muck ring 228 until the debris encounters the terminal edge 244 of the same at the top thereof. At this point, the debris tumbles onto the trough 58 of the vibrating conveyor 56, and is thereafter oscillated rearwardly of the same until it ultimately tumbles onto the belt conveyor 60 for removal from the tunnel site.

Ordinarily, the pulses of combustion gas are timed so that the back pressure at the face of the tunnel is at a minimum and the size of the gap 262 is such that the larger particles in the debris are able to escape through the slots without being ground against the face of the tunnel beforehand.

In many operations, a steady flow of pressurized fluid is more desirable, and in such a case a compressed air supply is commonly used in lieu of the illustrated engine hook-up. Also, an air flow is commonly employed where the combustion gases will pose an excessive pollution problem, such as where the gases can not be readily exhausted from the tunnel site during the tunnelling operation.

In addition to serving as skids on which the carriage can be trammed over the surface of the ground, the pads 9 on the bottom of the shoe 8 also function as restraining means with which to provide a counter thrust for the bit along the axis of reciprocation thereof. Moreover, referring again to FIG. 2, it will be seen that the pads 9 are not only symmetrically disposed on the outer peripheral surface of the shoe, but spaced apart from one another at acute angles to the vertical plane of the axis of reciprocation of the bit. As a consequence, the pads are frictionally engagable with the rounded but generally obliquely angled side wall surfaces on the opposing sides of the trench-like bottom portion of the tunnel, and in this disposition, generate substantial oppositely directed horizontal components in their bearing forces, which in turn generate a wedge effect between the surfaces as a major component of the counter thrust. In theory, the maximum wedge effect can be achieved by placing the pads near the horizontal plane of the axis. However, in practice the pads are arranged somewhat below this plane, yet at sufficient height to generate enough wedge effect to counter the maximum thrust anticipated for the particular sleeve and bit assembly to be carried by each carriage; and the disposition and number of skids is varied from one carriage to the next as is necessary to vary the horizontal and vertical components of the bearing forces for this purpose.

What is claimed is:

1. In combination, a moveably supported member, a support for reciprocably mounting the member, stroke shifting means which are operable to determine the location of the stroke of the member on said support along the axis of reciprocation of the member, so that points on the member and the support are spaced apart from one another a first distance when the member is at the limit of its stroke in one direction of reciprocation thereof, and whereby the location of the stroke can be shifted along the axis without substantially changing the length of the stroke, to relocate the points in closer proximity than said first distance to one another when the member is at the limit of its stroke relative to the support in the one direction of reciprocation thereof.

2. The combination according to claim 1 wherein the points are contact points operatively engagable with one another, and the stroke shifting means are infinitely variable and operable to engage the contact points when the member is at the limit of its stroke in the aforesaid one direction of reciprocation thereof.

3. The combination according to claim 2 wherein the support is moveably connected with the ground and the stroke shifting means are operable to enable the member to move the support in relation to the ground when the contact points are engaged with one another.

4. The combination according to claim 3 wherein a tool is connected with the member and the member is operable to drive the tool in relation to a work object at a work station, and wherein the stroke shifting means are operable to enable the member to move the support thereof relative to the object and/or the station.

5. The combination according to claim 4 wherein the tool is carried on the member and conjointly reciprocable therewith.

6. The combination according to claim 5 wherein the tool is rotatably carried on the member and there are means on the member whereby the tool can be rotated about the axis of reciprocation thereof while the member is reciprocating along the same.

7. The combination according to claim 3 wherein there are means for compensating for momentum lost by the member when the points are engaged with one another to move the support in relation to the object and/or the station.

8. The combination according to claim 4 wherein there are means for compensating for momentum lost by the member when the tool is engaged with the work object.

9. The combination according to claim 1 wherein the stroke shifting means are also operable to relocate the points at greater distance from one another when the member is at the aforesaid limit of its stroke in the one direction of reciprocation thereof.

10. The combination according to claim 9 wherein the points are releasably engagable with one another and the stroke shifting means are operable to engage and disengage the points when the member is at the limit of its stroke in the one direction of reciprocation thereof.

11. The combination according to claim 10 wherein the stroke determining means includes means which are responsive to reciprocation of the member to yieldably bias the points into the disengaged condition thereof, and the stroke shifting means are operable to vary the bias on the points so that they can engage one another when the member is reciprocated in the one direction thereof.

12. The combination according to claim 11 wherein the yieldable biasing means include a yieldable biasing element which is interconnected between the member and its support to tend to cause the points to disengage from one another, and the stroke shifting means include a yieldably biased control element which is interconnected between the member and the support to delimit the extent by which the points disengage from one another under the bias of the yieldable biasing element, and means for varying the bias on the control element to engage the points against the bias of the yieldable biasing element when the member is reciprocated in the one direction thereof.

13. The combination according to claim 12 wherein the control element is double-ended and relatively reciprocably interconnected with the member and the support so that the respective end portions thereof are disposed on opposite sides of the same from the yieldable biasing element, and wherein one of the end portions is yieldably biased in one direction of reciprocation of the control element, and the other is reciprocably engaged in a servomotor which is fluid operated to reciprocate the control element in the other direction of reciprocation thereof against the bias on the one end portion, to engage the points, or alternatively, permit the control element to reciprocate in the one direction thereof under the bias on the one end portion, to disengage the points.

14. The combination according to claim 2 wherein there are pairs of points on the member and the support which are releasably engagable with one another in the opposing directions of reciprocation of the member, and the stroke shifting means are operable to engage alternate pairs of points with one another.

15. The combination according to claim 14 wherein the stroke shifting means are operable to enable the member to move the support in relation to the ground, in either of opposing directions when the respective pairs of points are engaged with one another.

16. In combination, a large mass, moveably supported member reciprocably mounted in a support resting on a floor having reciprocable drive means thereon for reciprocating the large mass member, said srive means comprising a reciprocably driven piston-like element, means for reciprocating the piston-like element, transmission means to cause fore and aft reciprocation of the large mass member responsive to such reciprocation of the piston like element.

17. The combination according to claim 16 wherein a tool is connected with the member and the member is operable to drive the tool in relation to a work object at a work station.

18. The combination according to claim 16, including means selectively operable for causing the member to impact the support and move the support along the floor.

19. The combination according to claim 16 wherein the member defines a chamber having the piston-like element reciprocably engaged therein to be reciprocated between opposite ends thereof, and the drive means for the element include yieldable biasing means on one end portion of the chamber which are operable to displace the element in one direction of reciprocation thereof, and servo-displacement means on the other end portion of the chamber which are operable to intermittently displace the element against the bias of the yieldable biasing means, and wherein the transmission means are on the respective end portions of the chamber which are operable to convert the displacement of the piston-like element in the respective directions thereof, into reciprocable motion on the part of the member in corresponding directions.

20. The combination according to claim 19 wherein the one end portion of the chamber is closed and the servo-displacement means include means for alternately pressurizing and depressurizing the other end portion of the chamber to displace the piston-like element against a fluid captive in the one end portion thereof.

21. The combination according to claim 20 wherein the servo-displacement means include means for intermittently igniting a combustible charge in the other end portion of the chamber, and means for exhausting the combustion gases from the same when the piston-like element is displaced as indicated.

22. The combination according to claim 21 wherein the other end portion of the chamber is defined by a combustion engine having a port for exhausting the combination gases from the same when the piston-like element is displaced as indicated, and means whereby a new combustible charge can be compressed in the other end portion of the chamber when the piston-like element is displaced by the bias of the captive fluid in the one end portion thereof.

23. The combination according to claim 19 wherein the member has a chuck-like recess in the body thereof, the bottom portion of which is adapted as the aforesaid other end portion of the chamber, and wherein a tool is connected with the member in the recess and the tool has an opposing recess therein which defines the one end portion of the chamber, the piston-like element being slidably engaged in the respective recesses to be reciprocated between the opposite ends thereof.

24. The combination of claim 16, including means for shifting the location of the center of the reciprocating stroke of the large mass member axially relative to the support.

25. In combination, a moveably supported member which is reciprocable in relation to its support and which has conjointly reciprocable drive means thereon for reciprocating the same, and means including a port in the body thereof whereby debris can be pneumtically flushed away from the region adjacent the relatively forward end of the member in one direction of the reciprocation thereof, said drive means comprising a combustion engine and said flush means including a connection between the engine and the port whereby the combustion gases thereof can be conveyed to the port as the flush fluid for the debris, wherein the member has a chuck-like recess in the relatively forward end thereof for a tool, and the port is disposed in the recess for connection with fluid discharge means in the tool, wherein a tool is connected with the member in the recess, which has an intake port that is adapted to communicate with the port in the recess at the connection therebetween, and wherein the tool is rotatably connected with the member in the recess, and the connection includes valve means which are operable to prevent the respective ports from communicating with one another during a portion of the rotation of the tool when the body port is in the upper hemishpere of rotation.

26. The combination according to claim 25 wherein the member has a tool on the relatively forward end thereof which is adapted to generate debris in the region adjacent the end.

27. In combination, a moveably supported tool which is reciprocable in relation to its support and has a working head at one end of the axis of reciprocation thereof, said head having fluid apertures in the working face thereof which are disposed adjacent the outer peripheral edge of the same, and there being means interconnected with the head whereby a pressurized fluid can be discharged through the fluid apertures into the region adjacent the face of the head when the tool is generating debris from the work thereof, means on the head which operatively define a relatively low pressure zone at a point relatively rearwardly of the face, debris apertures operatively interconnected with the low pressure zone so that the fluid from the fluid apertures can transport the debris relatively away from the face of the head through the debris apertures, and wherein the tool is rotatably carried in a chuck which is reciprocably mounted in the support, and the fluid discharge means include means which are operable to prevent the fluid from communicating with the fluid apertures during the upper portion of their field of rotation when the tool is rotated in the chuck.

28. The combination according to claim 27 wherein the tool is adapted as a means for impacting a work object adjacent the working face of the head.

29. The combination according to claim 27 wherein there are means for shifting the stroke of the tool along the axis of reciprocation thereof, so that the opposite side of the head from the face thereof is spaced apart from the support when the tool is at the limit of its stroke in one direction of reciprocation thereof, and wherein the head has a relatively reduced neck on said opposite side of the face, so that a relatively low pressure annulus is formed in the region about the neck, and the debris apertures in the face take the form of axially extending slots in the outer peripheral edge of the face which open into the annulus at the opposite side of the head.

30. The combination according to claim 29 wherein the aforesaid one portion of the apertures is operatively disposed in the bottom portion of the head.

31. The combination according to claim 27 wherein the chuck has conjointly reciprocable drive means thereon for reciprocating the same, and the drive means comprise a combustion engine which is interconnected with the fluid discharge means so that the combustion gases thereof can be conveyed to the fluid apertures as the pressurized fluid for the debris.

32. The combination according to claim 27 wherein there are means on the neck whereby the tool is attached to a chuck, and the fluid discharge means include a port in the attachment means which is interconnected with the fluid apertures by a fluid flow passage in the body of the head.

33. The combination according to claim 32 wherein the neck has a shank-like axial extension thereon and the port in the same is disposed to communicate with a port in the chuck at its interface with the extension.

34. In combination, a reciprocably supported member, a support for reciprocably mounting the member for movement along an axis, said support being mounted on skids on the ground, said skids being slidably engaged with the ground and there being drive means for reciprocating the member relative to the support, operatively engagable abutment means on the member and the support, and control means whereby the abutment means can be releasably engaged with one another to transmit motion of the member into motion of the support along said axis to tram the support over the surface of the ground on the skids.

35. The combination according to claim 34 wherein the member has a rotary drill bit on the relatively forward end thereof, and the drive means are carried on the member and conjointly reciprocable therewith.

36. The combination according to claim 35 wherein there are means connected with the bit for entraining the debris generated by the same in a fluid, and means on the support for collecting and discharging the fluid borne debris relatively rearwardly of the support.

37. In combination, a carriage moveably supported on a surface, and an apparatus for driving a tool or the like at a work station, and/or the carriage relative to the surface, said apparatus comprising a driven member which is moveably mounted on the carriage to reciprocate in relation to the carriage, propulsion means for reciprocating the driven member, first transmission means which are operable to interconnect the driven member with the tool or the like and responsive to reciprocation of the driven member to drive the tool or the like in relation to the support surface, second transmission means which are operable to interconnect the driven member with the carriage and responsive to reciprocation of the driven member to drive the carriage in relation to the support surface, and control means which are operable to selectively actuate and deactuate said second transmission means when the driven member undergoes reciprocation.

38. The combination according to claim 37 wherein the apparatus further comprises means for compensating for momentum lost by the driven member when the one transmission means is actuated.

39. The combination according to claim 37 wherein the apparatus further comprises means for compensating for momentum lost by the driven member when the tool or the like is operated at the work station.

40. The combination according to claim 37 wherein the second transmission means includes a sleeve element which is moveably mounted on the carriage and responsive to reciprocation of the driven member to undergo lost motion with respect to the carriage and its support surface, and the control means are operable to vary the lost motion of the element relative to the carriage, to actuate and deactuate the second transmission means.

41. The combination according to claim 40 wherein the second transmission means includes the foregoing sleeve element, and the control means are operable to vary the lost motion of the sleeve element relative to the carriage, to drive the carriage in relation to its support surface.

42. The combination according to claim 40 wherein the second transmission means include a plurality of spaced elements which are moveably mounted on the carriage and responsive to reciprocation of the driven member to undergo lost motion with respect to the carriage and its support, and the control means are operable to vary the lost motion of the elements relative to the carriage, alternatively, to drive the carriage in one direction of its movement, or to drive the carriage in an opposing direction of its movement.

43. The combination according to claim 37 wherein the first and second transmission means include first and second elements, respectively, which are moveably mounted on the carriage and responsive to reciprocation of the driven member to undergo lost motion with respect to the carriage and its support, and the control means are operable to vary the lost motion of the same relative to the carriage, to drive the tool or the like in relation to the support surface when the carriage is driven in relation thereto, and vice versa.

44. The combination according to claim 43 wherein the first and second elements are interconnected with one another to undergo lost motion in conjunction with one another in response to reciprocation of the driven member, and the control means are operable to vary the lost motion of the same relative to the carriage, alternatively, to drive the tool or the like in relation to the carriage and the support surface, or to drive the tool or the like and the carriage in relation to the support.

45. The combination according to claim 44 wherein the first and second elements are moveably mounted on the carriage to reciprocate in relation to the carriage and its support surface, and the control means are operable to engage the second element with the carriage when it is desired to drive both the tool or the like, and the carriage, in relation to the support surface, or alternatively, to disengage the second element from the carriage when it is desired to drive the tool or the like in relation to the carriage and the support surface.

46. The combination according to claim 45 wherein the control means include means which are responsive to reciprocation of the driven member to yieldably bias the second element into the disengaged condition thereof relative to the carriage, and servo-control means which are operable to vary the bias on the second element so that it can engage with the carriage when the first element is reciprocated in relation thereto.

47. The combination according to claim 46 wherein the yieldable biasing means include a yieldable biasing member which is interconnected between the carriage and the driven member to tend to cause the second element to disengage from the carriage, and the servo-control means include a yieldably biased control member which is interconnected between the carriage and the driven member to delimit the extent by which the second element disengages from the carriage under the bias of the yieldable biasing member, and means for varying the bias on the control member to engage the second element with the carriage against the bias of the yieldable biasing member when the first element is reciprocated in relation to the carriage.

48. The combination according to claim 47 wherein the control member is double-ended and relatively reciprocably interconnected with the carriage and the driven member so that the respective end portions thereof are disposed on opposite sides of the same from the yieldable biasing member; and wherein one of the end portions is yieldably biased in one direction of reciprocation of the control member, and the other is reciprocably engaged in a servomotor which is fluid operated at selectively reciprocate the control member in the other direction of reciprocation thereof against the bias on the one end portion, to engage the second element with the carriage, or alternatively, permit the control member to reciprocate in the one direction thereof under the bias on the one end portion, to disengage the second element from the carriage.

49. The combination according to claim 27 wherein the first transmission means includes a first element, and the second transmission means includes spaced second and third elements, which are moveably mounted on the carriage and responsive to reciprocation of the driven member to undergo lost motion with respect to the carriage and its support surface, and the control means are operable to vary the lost motion of the same relative to the carriage, to drive the tool or the like in relation to the support surface when the carriage is driven in relation thereto, either in the one direction of movement of the carriage, or in the opposing direction of movement thereof.

50. The combination according to claim 49 wherein the first, second and third elements are interconnected with one another to undergo lost motion in conjunction with one another in response to reciprocation of the driven member, and the control means are operable to vary the lost motion of the same relative to the carriage, alternatively, to drive the tool or the like in relation to the carriage and the support surface, or to drive the tool or the like and the carriage in relation to the support surface, either in the one direction of movement of the carriage or in the opposing direction of movement thereof.

51. The combination according to claim 50 wherein the first, second and third elements are moveably mounted on the carriage to reciprocate in relation to the carriage and its support surface, and the control means are operable to engage the second element with the carriage when it is desired to drive both the tool or the like, and the carriage, in relation to the support, and the carriage in one direction of movement thereof, or alternatively, to engage the third element with the carriage when it is desired to drive both the tool or the like, and the carriage, in relation to the support surface, and the carriage in an opposing direction of movement thereof, or alternatively, to disengage the second and third elements from the carriage when it is desired to drive the tool or the like in relation to the carriage and the support.

52. The combination according to claim 51 wherein the control means include means which are responsive to reciprocation of the driven member to yieldably bias the second and third elements into the disengaged condition thereof relative to the carriage, and servo-control means which are operable to vary the bias on the second and third elements so that one or the other of them can engage with the carriage when the first element is reciprocated in relation thereto.

53. The combination according to claim 52 wherein the yieldable biasing means include a yieldable biasing member which is interconnected between the carriage and the driven member to tend to cause the second element to disengage from the carriage and the third element to engage the same, and the servo-control means include a yieldably biased control member which is interconnected between the carriage and the driven member to delimit the extent by which the second and third elements disengage from and engage with the carriage, respectively, under the bias of the yieldable biasing member, and means for varying the bias on the control member either to engage the second element with the carriage against the bias of the yieldable biasing member, or to engage the third element with the carriage under the bias of the yieldable biasing member, when the first element is reciprocated in relation to the carriage.

54. The combination according to claim 53 wherein the control member is double-ended and relatively reciprocably interconnected with the carriage and the driven member so that the respective end portions thereof are disposed on opposite sides of the same from the yieldable biasing member, and wherein one of the end portions is yieldably biased in one direction of reciprocation of the control member, and the other is reciprocably engaged in a servomotor which is fluid operated to selectively reciprocate the control member in the other direction of reciprocation thereof against the bias on the one end portion to engage the second element with the carriage, or alternatively, permit the control member to reciprocate in the one direction thereof under the bias on the one end portion to engage the third element with the carriage.

55. The combination according to claim 54 wherein the carriage and driven member have opposing flanges thereon, and the control member is slidably guided in the flanges and equipped with a pair of piston-like heads on the respective ends thereof, and wherein the yieldable biasing member is interposed between the flanges, and the bias on the control member is supplied by a second yieldable biasing member which is interposed between one head of the control member and the flange on the carriage, and wherein the servomotor is carried on the flange of the driven member and the other head of the control member is slidably engaged in the chamber of the same.

56. The combination according to claim 55 wherein the first and second mentioned yieldable biasing members take the form of resilient compression elements.

57. The combination according to claim 56 wherein the resilient compression elements take the form of coiled springs.

58. The combination according to claim 49 wherein the first, second and third elements are carried on the driven member.

59. The combination according to claim 49 wherein the first, second and third elements constitute portions of the driven member.

60. The combination according to claim 59 wherein the first element portion of the driven member has means thereon whereby an attachment member of a tool or the like can be connected with the same to render the driven member a tool drive member.

61. The combination according to claim 60 wherein the first element portion has a recess therein whereby a tool shank or the like can be interengaged with the driven member for the foregoing purpose.

62. The combination according to claim 60 wherein the first element portion is adapted so that the attachment member can be rotatably mounted on the driven member, and the driven member has means thereon for rotating the attachment member when the driven member is reciprocated in relation to the carriage and/or its support surface.

63. The combination according to claim 62 wherein the driven member takes the form of a sleeve, the bore of which is adapted to receive a tool shank that is equipped with means whereby it can be rotatably engaged on the driven member to reciprocate therewith.

64. The combination according to claim 63 wherein the means for rotating the shank include a power driven motor means which is carried on the driven member and interconnectible with the shank to rotate the same in the bore of the sleeve when the sleeve is undergoing reciprocation.

65. The combination according to claim 63 wherein the sleeve is slidably guided in the carriage, and the second and third element portions of the same take the form of relatively outturned flanges on the opposite end portions of the sleeve, which are engageable with mutually opposing stops on the carriage.

66. The combination according to claim 65 wherein the carriage is tubular and the sleeve is telescopically engaged in the bore of the same, so that the ends of the carriage form the stops for the flanges of the sleeve.

67. The combination according to claim 37 wherein the means for reciprocating the driven member is carried on the member and conjointly reciprocable therewith.

68. The combination according to claim 67 wherein the driven member has a piston-like element reciprocably engaged thereon, and there are drive means on the member for reciprocating the element, and transmission means whereby the member is responsive to reciprocation of the element to undergo reciprocation along a parallel to the axis of reciprocation thereof.

69. The combination according to claim 68 wherein the member has means thereon defining a chamber having the pistonlike element reciprocably engaged therein to be reciprocated between opposite ends thereof, and the drive means for the element include yieldable biasing means on one end portion of the chamber which are operable to displace the element in one direction of reciprocation thereof, and servo-displacement means on the other end portion of the chamber which are operable to intermittently displace the element against the bias of the yieldable biasing means, and wherein the transmission means include means on the respective end portions of the chamber which are operable to convert the displacement of the element in the respective directions thereof, into reciprocable motion on the part of the driven member in corresponding directions.

70. The combination according to claim 69 wherein the one end portion of the chamber is closed and the servo-displacement means include means for alternately pressurizing and depressurizing the other end portion of the chamber to displace the piston-like element against a fluid captive in the one end portion thereof.

71. The combination according to claim 70 wherein the servo-displacement means include means for intermittently igniting a combustible charge in the other end portion of the chamber, and means for exhausting the combustion gases from the same when the piston-like element is displaced as indicated.

72. The combination according to claim 71 wherein the other end portion of the chamber is defined by a combustion engine having a port for exhausting the combustion gases thereof from the same when the piston-like element is displaced as indicated, and means whereby a new combustible charge can be compressed in the other end portion of the chamber when the piston-like element is displaced by the bias of the captive fluid in the one end portion thereof.

73. The combination according to claim 69 wherein the apparatus further comprises a tool attachment member which is operatively carried on the driven member to reciprocate in unison therewith, and equipped with means cooperating with the driven member to define the chamber for the piston-like element.

74. The combination according to claim 73 wherein the attachment member is rotatably carried on the driven member, and the apparatus further comprises means for rotating the attachment member in relation to the driven member when the attachment member is undergoing reciprocation with the same.

75. The combination according to claim 73 wherein the driven member has a chuck-like recess therein defining the aforesaid other end portion of the chamber, and the attachment member is connected to the driven member in the recess and equipped with an opposing recess which defines the one end portion of the chamber, the piston-like element being slidably engaged in the respective recesses to be reciprocated between the bottoms thereof.

76. The combination according to claim 73 wherein the tool attachment member has a tool or the like carried thereon.

77. The combination according to claim 76 wherein the tool or the like is fixed on the attachment member.

78. The combination according to claim 73 wherein the attachment member takes the form of a shank which is rotatably engaged on the driven member and equipped with a drill bit that is rotated about the axis of reciprocation of the driven member while being reciprocated in unison with the same.

79. The combination according to claim 37 wherein the driven member has a tool or the like thereon which generates cuttings or other debris in the region adjacent the relatively forward end of the same in one direction of its reciprocation, and wherein the apparatus further comprises means for removing the debris from said region.

80. The combination according to claim 79 wherein the debris removal means include means for discharging a fluid through the body of the driven member, to flush the debris from said region.

81. The combination according to claim 80 wherein the fluid discharge means is operable to discharge the fluid through the body of the tool or the like at the working face thereof.

82. The combination according to claim 81 wherein the fluid discharge means is operable to discharge the fluid adjacent the outer peripheral edge of the working face.

83. The combination according to claim 82 wherein the fluid discharge means is operable to discharge the fluid intermittently through the face.

84. The combination according to claim 83 wherein the tool is rotatably carried on the driven member and rotated about the axis of reciprocation thereof, and wherein the fluid discharge means is operable to discharge the fluid during only a portion of the field of rotation of the tool or the like.

85. In combination, a carriage mounted percussive tool for impacting a work object, the carriage being moveably supported on the ground and the tool being moveably mounted on the carriage to be reciprocated in relation thereto, and there being drive means for reciprocating the tool in relation to the carriage and the ground, and control means whereby the tool can be releasably engaged with the carriage to move the carriage in relation to the ground while the tool is reciprocating in relation thereto.

86. The combination according to claim 85 wherein the tool takes the form of a drill bit and there are means whereby the bit can be rotated about the axis of reciprocation thereof, while it is being impacted on the work object, so as to bore a hole therein, and wherein the drive means is carried on the tool and conjointly reciprocable therewith so that the carriage and tool unit can be selfadvanced into the hole as it is deepened.

87. The combination according to claim 85 wherein the control means include means for determining the stroke of the tool along the axis of reciprocation thereof, and means for shifting the stroke along said axis to releasably engage the tool with the carriage when it is desired to move the carriage in relation to the ground.

88. The combination according to claim 85 further comprising means for compensating for momentum lost by the tool when it engages the carriage and/or the work object.

89. In combination, a large mass member, a ground-supported support frame reciprocably mounting said large mass member, an elongated piston chamber within said large mass member, a free-floating piston within said piston chamber, and gas cushion force transmission means at opposite ends of said piston chamber for compressing gas at opposite ends of the piston stroke for imparting reciprocation of said piston into cushioned reciprocation of said large mass member whereby the large mass is reciprocated for doing work without impact with said piston, and means selectively operable for impacting said support frame with said large mass member for sliding the entire support frame along the ground in the direction of impact.

90. The combination of claim 89, including stroke shifting means for shifting the location of the reciprocating motion of said large mass member on said support frame for varying the impact energy to vary the extent of movement of the support frame.

91. The combination of claim 90, said stroke shifting means including spring means connected between the large mass member and the support frame, and adjustable spring force varying means for varying the force of the spring means in a desired direction along the axis of reciprocation of the large mass member for shifting the location of the reciprocating motion of the large mass member on the support frame.

92. In combination, a moveably supported member, support means moveable on the ground and reciprocably mounting said member, propulsion means for reciprocating the member on the support means, and selective impact transmission means between the member and the support means for directly impacting the support means by the member, and stroke shifting means for shifting the location of the reciprocating motion of the member on said support means whereby the member and support means can be moved along the ground.

93. The combination of claim 92, said impact transmission means including first spaced abutment means on the member and second spaced abutment means on said support means, and said stroke shifting means including spring means connected between said support means and said member and means for varying the force of said spring means in a desired direction along the axis of reciprocation of the member to change the spacing between the first and second abutment means for varying the distance and direction of impact between the abutment means on the member and the abutment means on the support means to advance or retract the support means along the ground.

94. The combination of claim 92, said means for varying the force on the spring means including elongated cylinder and piston rod means coupled to said spring means and to said support means and being extendible for varying the force and direction of said spring means.

95. Drilling apparatus having a tool with a head for impacting against a work surface to be removed, said head having a forward drilling face, means for reciprocating the tool along a substantially horizontal axis for impacting the work surface, said reciprocating means moving the face of the head with each stroke a substantial distance away from the work surface so that a clearance gap is created between the work surface and the face during each stroke, fluid apertures around the drilling face for introducing pressurized fluid into said gap, and debris apertures around the drilling face extending through the head to pass debris rearwardly of the head.

96. The drilling apparatus of claim 95, including means for limiting passage of fluid through the fluid apertures only to the lower half of the drilling face, whereby large pieces of debris can fall into said gap and be cleared through said debris apertures.

97. The apparatus of claim 96, said head being rotatable, and including means for rotating the head.

98. The apparatus of claim 97, said drilling face being generally conical, said debris apertures including a plurality of radially extending, elongated slots.

* * * * *